US010650794B2

(12) United States Patent
Maezawa

(10) Patent No.: US 10,650,794 B2
(45) Date of Patent: May 12, 2020

(54) TIMING CONTROL METHOD AND TIMING CONTROL DEVICE

(71) Applicant: Yamaha Corporation, Hamamatsu, Shizuoka (JP)

(72) Inventor: Akira Maezawa, Shizuoka (JP)

(73) Assignee: YAMAHA CORPORATION, Shizuoka (JP)

( * ) Notice: Subject to any disclaimer, the term of this patent is extended or adjusted under 35 U.S.C. 154(b) by 0 days.

(21) Appl. No.: 16/252,187

(22) Filed: Jan. 18, 2019

(65) Prior Publication Data

US 2019/0156801 A1 May 23, 2019

Related U.S. Application Data

(63) Continuation of application No. PCT/JP2017/026527, filed on Jul. 21, 2017.

(30) Foreign Application Priority Data

Jul. 22, 2016 (JP) ..... 2016-144351

(51) Int. Cl.
*G10H 1/00* (2006.01)
*G10H 1/40* (2006.01)
(Continued)

(52) U.S. Cl.
CPC ..... *G10H 1/0025* (2013.01); *G10G 3/04* (2013.01); *G10H 1/00* (2013.01); *G10H 1/0041* (2013.01);
(Continued)

(58) Field of Classification Search
CPC .... G10H 1/0025; G10H 5/007; G10H 1/0041; G10H 1/40; G10H 2240/325;
(Continued)

(56) References Cited

U.S. PATENT DOCUMENTS 4,341,140 A * 7/1982 Ishida ..... G10H 1/0091 84/477 B
5,177,311 A * 1/1993 Suzuki ..... G10H 1/00 84/600
(Continued)

FOREIGN PATENT DOCUMENTS

JP H05-27752 A 2/1993
JP 2007-241181 A 9/2007
JP 2015-079183 A 4/2015

OTHER PUBLICATIONS

International Search Report in PCT/JP2017/026527 dated Sep. 26, 2017.

*Primary Examiner* — Jeffrey Donels
(74) *Attorney, Agent, or Firm* — Global IP Counselors, LLP

(57) ABSTRACT

A timing control method includes generating a timing designation signal according to one of a first generation mode for generating the timing designation signal which designates, based on a detection result of a first event in a performance of a music piece, a timing of a second event in the performance, and a second generation mode for generating the timing designation signal without using the detection result, and outputting a command signal for commanding an execution of the second event according to one of a first output mode for outputting the command signal in accordance with the timing designated by the timing designation signal, and a second output mode for outputting the command signal in accordance with a timing determined based on the music piece.

14 Claims, 10 Drawing Sheets

(51) Int. Cl.
*G10G 3/04* (2006.01)
*G10H 5/00* (2006.01)

(52) U.S. Cl.
CPC ..... *G10H 1/0058* (2013.01); *G10H 1/40* (2013.01); *G10H 5/007* (2013.01); *G10H 2240/325* (2013.01); *G10H 2250/015* (2013.01)

(58) Field of Classification Search
CPC .. G10H 1/0058; G10H 1/00; G10H 2250/015; G10G 3/04
USPC ..... 84/609
See application file for complete search history.

(56) References Cited

U.S. PATENT DOCUMENTS 5,288,938 A * 2/1994 Wheaton ..... G06K 9/00335 84/600
5,648,627 A * 7/1997 Usa ..... G10H 1/0556 706/900
5,663,514 A * 9/1997 Usa ..... G10H 1/0008 84/600
5,913,259 A * 6/1999 Grubb ..... G10H 1/36 84/610
6,166,314 A * 12/2000 Weinstock ..... G10G 3/04 84/477 R
6,919,503 B2 * 7/2005 Nishitani ..... G10H 1/0058 84/633
8,445,771 B2 * 5/2013 Sakazaki ..... G10H 1/0008 84/626
8,586,853 B2 * 11/2013 Sakazaki ..... G10H 1/053 84/725
9,171,531 B2 * 10/2015 David ..... G10H 1/40
10,418,012 B2 * 9/2019 Katz ..... G10H 1/42
2002/0170413 A1 * 11/2002 Nishitani ..... G10H 1/0066 84/600
2010/0017034 A1 * 1/2010 Nakadai ..... A63H 3/28 700/258
2011/0214554 A1 * 9/2011 Nakadai ..... G09B 15/02 84/477 R
2015/0143976 A1 * 5/2015 Katto ..... A63F 13/211 84/602
2019/0012997 A1 * 1/2019 Katz ..... G10H 1/045
2019/0147837 A1 * 5/2019 Maezawa ..... G10G 3/04
2019/0156801 A1 * 5/2019 Maezawa ..... G10H 1/40
2019/0156802 A1 * 5/2019 Maezawa ..... G10H 1/0025
2019/0156809 A1 * 5/2019 Maezawa ..... G10H 1/00
2019/0172433 A1 * 6/2019 Maezawa ..... G10G 1/00

* cited by examiner

TIMING CONTROL METHOD AND TIMING CONTROL DEVICE

CROSS-REFERENCE TO RELATED APPLICATIONS

This application is a continuation application of International Application No. PCT/JP2017/026527, filed on Jul. 21, 2017, which claims priority to Japanese Patent Application No. 2016-144351 filed in Japan on Jul. 22, 2016. The entire disclosures of International Application No. PCT/JP2017/026527 and Japanese Patent Application No. 2016-144351 are hereby incorporated herein by reference.

BACKGROUND

Technological Field

The present invention relates to a timing control method and a timing control device.

Background Information

A technology for estimating a position of a performer's performance on a musical score (performance position) based on a sound signal that indicates an emission of sound by the performer is known (for example, refer to Japanese Laid-Open Patent Application No. 2015-79183 (Patent Document 1)).

In an ensemble system in which a performer and an automatic performance instrument, and the like, play together, for example, a timing of an event in which the automatic performance instrument emits a next sound is predicted based on an estimation result of the performance position of the performer, and the automatic performance instrument is instructed to execute the event in accordance with the predicted timing. In the ensemble system described above, when the timing of the event to be performed by the automatic performance instrument is predicted based on the estimation result of the performance position of the performer, there are some cases in which a process for predicting the timing becomes unstable. However, it is necessary to prevent the performance by the automatic performance instrument from becoming unstable, even when the process for predicting the timing becomes unstable.

SUMMARY

The present invention was made in light of the circumstance described above, and one solution thereto is to provide a technology for preventing the performance by the automatic performance instrument from becoming unstable.

A timing control method according to an aspect of this disclosure includes generating a timing designation signal according to one of a first generation mode for generating the timing designation signal which designates, based on a detection result of a first event in a performance of a music piece, a timing of a second event in the performance, and a second generation mode for generating the timing designation signal without using the detection result, and outputting a command signal for commanding an execution of the second event according to one of a first output mode for outputting the command signal in accordance with the timing designated by the timing designation signal, and a second output mode for outputting the command signal in accordance with a timing determined based on the music piece.

Alternatively, a timing control method according to an aspect of this disclosure includes generating, based on a detection result of a first event in a performance of a music piece, a timing designation signal to designate a timing of a second event in the performance, and outputting a command signal for commanding an execution of the second event according to one of a first output mode for outputting the command signal in accordance with the timing designated by the timing designation signal, and a second output mode for outputting the command signal in accordance with a timing determined based on the music piece.

Alternatively, the timing control method according to an aspect of this disclosure includes generating a timing designation signal according to one of a first generation mode for generating the timing designation signal which designates, based on a detection result of a first event in a performance of a music piece, a timing of a second event in the performance, and a second generation mode for generating the timing designation signal without using the detection result, and outputting a command signal for commanding an execution of the second event in accordance with the timing designated by the timing designation signal.

In addition, a timing control device according to an aspect of this disclosure includes an electronic controller having at least one processor. The electronic controller is configured to execute a plurality of modules including a generation module that generates a timing designation signal according to one of a first generation mode for generating the timing designation signal which designates, based on a detection result of a first event in a performance of a music piece, a timing of a second event in the performance, and a second generation mode for generating the timing designation signal without using the detection result, and an output module that outputs a command signal for commanding an execution of the second event according to one of a first output mode for outputting the command signal in accordance with the timing designated by the timing designation signal, and a second output mode for outputting the command signal in accordance with a timing determined based on the music piece.

DETAILED DESCRIPTION OF THE EMBODIMENTS

Selected embodiments will now be explained with reference to the drawings. It will be apparent to those skilled in the field of musical performances from this disclosure that the following descriptions of the embodiments are provided for illustration only and not for the purpose of limiting the invention as defined by the appended claims and their equivalents.

1. Configuration

Figure 1:
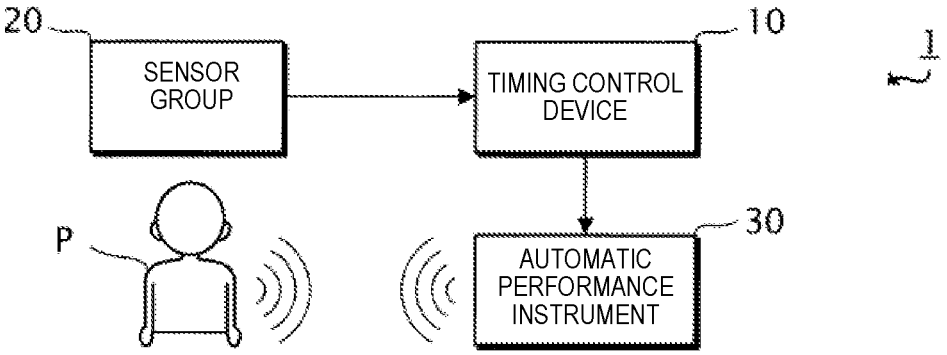
FIG. 1 is a block diagram showing a configuration of an ensemble system 1 according to an embodiment.

FIG. 1 is a block diagram showing a configuration of an ensemble system 1 according to the present embodiment. The ensemble system 1 is used for a human performer P and an automatic performance instrument 30 to execute a performance. That is, in the ensemble system 1, the automatic performance instrument 30 carries out a performance in accordance with the performance of the performer P. The ensemble system 1 comprises a timing control device 10, a sensor group 20, and the automatic performance instrument 30. In the present embodiment, a case in which a music piece that is played together by the performer P and the automatic performance instrument 30 will be assumed. That is, the timing control device 10 stores music data which represent a musical score of the music piece that is played together by the performer P and the automatic performance instrument 30.

The performer P plays a musical instrument. The sensor group 20 detects information relating to the performance by the performer P. In the present embodiment, the sensor group 20 includes, for example, a microphone that is placed in front of the performer P. The microphone collects the sounds of the performance sound that is emitted from the instrument that is played by the performer P, converts the collected performance sound into a sound signal and outputs the sound signal.

The timing control device 10 is a device for controlling a timing at which the automatic performance instrument 30 performs following the performance of the performer P. The timing control device 10 carries out three processes based on the sound signal that is supplied from the sensor group 20: (1) estimating the position of the performance on the musical score (can be referred to as "estimating the performance position"), (2) predicting a time (timing) at which a next sound should be emitted in the performance by the automatic performance instrument 30 (can be referred to as "predicting the sound generation time"), and (3) outputting a command signal that indicates a performance command with respect to the automatic performance instrument 30 (can be referred to as "outputting the performance command"). Here, estimating the performance position is a process for estimating the position on the musical score of the ensemble by the performer P and the automatic performance instrument 30. Predicting the sound generation time is a process for predicting the time at which the next sound generation should be carried out by the automatic performance instrument 30 using an estimation result of the performance position. Outputting the performance command is a process for outputting the command signal indicating the performance command with respect to the automatic performance instrument 30 in accordance with the predicted sound generation time. The sound generated by the performer P in the performance is one example of the "first event" and the sound generated by the automatic performance instrument 30 in the performance is one example of the "second event". Hereinbelow, the first event and the second event can be collectively referred to as "events." The sound signal is one example of the "detection result" of the first event in the performance of the music piece.

The automatic performance instrument 30 is capable of carrying out a performance in accordance with the performance command that is supplied by the timing control device 10, irrespective of human operation, one example being an automatic playing piano.

Figure 2:
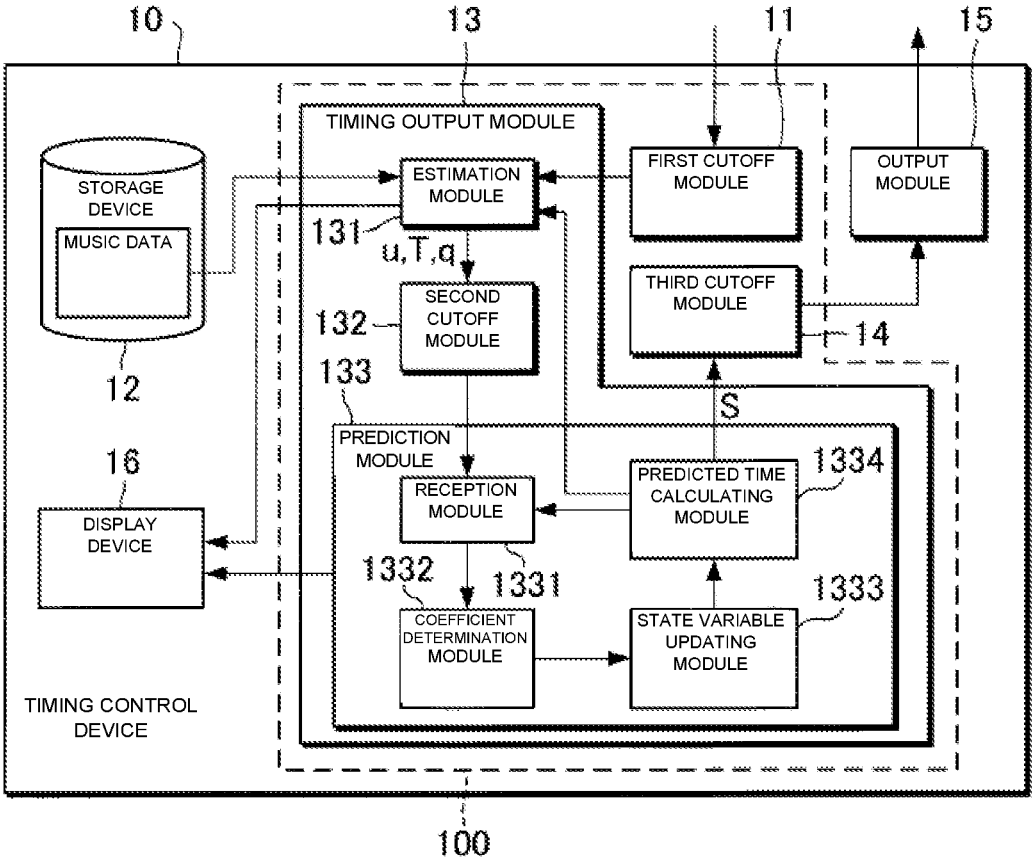
FIG. 2 is a block diagram illustrating a functional configuration of a timing control device 10.

FIG. 2 is a block diagram illustrating a functional configuration of the timing control device 10. The timing control device 10 comprises a timing generation module 100 (one example of a "generation module"), a storage device 12, an output module 15, and a display device 16. Of the foregoing, the timing generation module 100 includes a first cutoff module 11, a timing output module 13, and a third cutoff module 14.

The storage device 12 stores various data. In this example, the storage device 12 stores music data. The music data include at least tempo and pitch of the generated sounds that are designated by a musical score. The timing of the generated sounds indicated by the music data is, for example, expressed based on time units (for example, a thirty-second note) that are set on the musical score. In addition to the tempo and pitch of the generated sounds that are designated by the musical score, the music data can also include information that indicates at least one or more of sound length, tone, or sound volume each of which is designated by the musical score. For example, the music data are data in the MIDI (Musical Instrument Digital Interface) format.

The timing output module 13 predicts the time at which the next generated sound should be carried out by the automatic performance instrument 30 in the performance, in accordance with the sound signal that is supplied from the sensor group 20. The timing output module 13 includes an estimation module 131, a second cutoff module 132, and a prediction module 133.

The estimation module 131 analyzes the input sound signal and estimates the performance position on the musical score. The estimation module 131 first extracts information relating to the pitch and an onset time (sound generation start time) from the sound signal. Next, the estimation module 131 calculates, from the extracted information, a stochastic estimated value which indicates the performance position on the musical score. The estimation module 131 outputs the estimated value obtained by means of the calculation.

In the present embodiment, the estimated value that is output by the estimation module 131 includes a sound generation position u, an observation noise q, and a sound generation time T. The sound generation position u is the position on the musical score (for example, the second beat of the fifth measure) of a sound that is generated during the performance by the performer P or the automatic performance instrument 30. The observation noise q is the observation noise (stochastic fluctuation) of the sound generation position u. The sound generation position u and the observation noise q are expressed, for example, based on the time units that are set on the musical score. The sound generation time T is the time (position on a time axis) at which sound generated by the performer P during the performance is observed. In the description below, the sound generation position that corresponds to the nth music note that is sounded during the performance of the music piece is expressed as u[n] (where n is a natural number that satisfies n≥1). The same applies to the other estimated values.

The prediction module 133 predicts the time (predicts the sound generation time) at which the next sound generation should be carried out in the performance by the automatic performance instrument 30 by means of using the estimated value that is supplied from the estimation module 131 as an observation value. In the present embodiment, a case in which the prediction module 133 predicts the sound generation time using a so-called Kalman filter will be assumed as an example.

Hereinbelow, the prediction of the sound generation time according to the related technology will be described before the prediction of the sound generation time according to the present embodiment is described. Specifically, the prediction of the sound generation time using a regression model and the prediction of the sound generation time using a dynamic model will be described as the prediction of the sound generation time according to the related technology.

First, with regard to the prediction of the sound generation time according to the related technology, the prediction of the sound generation time using the regression model will be described.

The regression model estimates the next sound generation time using the history of the times that sounds were generated by the performer P and the automatic performance instrument 30. The regression model can be expressed by the following equation (1), for example.

Equation $$S[n+1] = G_n \begin{pmatrix} S[n] \\ S[n-1] \\ \vdots \\ S[n-j] \end{pmatrix} + H_n \begin{pmatrix} u[n] \\ u[n-1] \\ \vdots \\ u[n-j] \end{pmatrix} + \alpha_n \quad (1)$$

Here, the sound generation time S[n] is the sound generation time of the automatic performance instrument 30. The sound generation position u[n] is the sound generation position of the performer P. In the regression model shown in equation (1), a case is assumed in which the sound generation time is predicted using "j+1" observation values (where j is a natural number that satisfies 1≤j<n). In the description relating to the regression model shown in equation (1), a case is assumed in which the sound performed by the performer P can be distinguished from the performance sound of the automatic performance instrument 30. The matrix $G_n$ and the matrix $H_n$ are matrices corresponding to regression coefficients. The subscript n in the matrix $G_n$, the matrix $H_n$, and the coefficient $\alpha_n$ indicates that the matrix $G_n$, the matrix $H_n$, and the coefficient $\alpha_n$ are elements that correspond to the nth music note that is played. That is, when using the regression model shown in equation (1), the matrix $G_n$, the matrix $H_n$, and the coefficient $\alpha_n$ can be set in one-to-one correspondence with a plurality of music notes that are included in the musical score of the music piece. In other words, it is possible to set the matrix $G_n$, the matrix $H_n$, and the coefficient $\alpha_n$ in accordance with the position on the musical score. As a result, according to the regression model shown in equation (1), it becomes possible to predict the sound generation time S in accordance with the position on the musical score.

Next, with regard to the prediction of the sound generation time according to the related technology, the prediction of the sound generation time using the dynamic model will be described.

In general, in the dynamic model, a state vector V that represents a state of a dynamic system to be a target of prediction by the dynamic model is updated by means of the following process, for example.

Specifically, first, the dynamic model predicts the state vector V after a change from the state vector V before the change, using a state transition model, which is a theoretical model that represents temporal changes in the dynamic system. Second, the dynamic model predicts the observation value from a predicted value of the state vector V according to the state transition model, using an observation model, which is a theoretical model that represents the relationship between the state vector V and the observation value. Third, the dynamic model calculates an observation residual based on the observation value predicted by the observation model and the observation value that is actually supplied from outside of the dynamic model. Fourth, the dynamic model calculates an updated state vector V by correcting the predicted value of the state vector V according to the state transition model by using the observation residual. The dynamic model updates the state vector V in this manner.

In the present embodiment, a case is assumed in which the state vector V includes a performance position x and a velocity v as elements, for example. Here, the performance position x is a state variable that represents the estimated value of the performance position of the performer P or the automatic performance instrument 30 on the musical score. In addition, the velocity v is a state variable that represents the estimated value of the velocity (tempo) of the performance by the performer P or the automatic performance instrument 30 on the musical score. However, the state vector V can include state variables other than the performance position x and the velocity v.

In the present embodiment, a case is assumed in which the state transition model is represented by the following equation (2), and the observation model is represented by the following equation (3), for example.

Equation $$V[n]=A_n V[n-1]+e[n] \quad (2)$$

Equation $$u[n]=O_n V[n]+q[n] \quad (3)$$

Here, the state vector V[n] is a k-dimensional vector (where k is a natural number that satisfies k≥2), having, as elements, a plurality of state variables including the performance position x[n] and the velocity v[n], which correspond to the nth music note that is played. The process noise e[n] is a k-dimensional vector that represents noise which accompanies a state transition that uses the state transition model. The matrix $A_n$ represents the coefficient that relates to the updating of the state vector V in the state transition model. The matrix $O_n$ represents the relationship between the observation value (in this example, the sound generation position u) and the state vector V in the observation model. The subscript n appended to each type of element, such as the matrices and the variables, indicates that said element is an element that corresponds to the nth music note.

Equations (2) and (3) can be embodied, for example, as the following equation (4) and equation (5).

Equation $$\begin{pmatrix} x[n] \\ v[n] \end{pmatrix} = \begin{pmatrix} 1 & T[n]-T[n-1] \\ 0 & 1 \end{pmatrix} \begin{pmatrix} x[n-1] \\ v[n-1] \end{pmatrix} + e[n] \tag{4}$$

Equation $$u[n] = x[n] + q[n] \tag{5}$$

If the performance position x[n] and the velocity v[n] can be obtained from the equation (4) and the equation (5), it is possible to obtain the performance position x[t] at a future time t from the following equation (6).

Equation $$x[t]=x[n]+v[n](t-T[n]) \tag{6}$$

By applying the calculation result according to equation (6) to the following equation (7), it is possible to calculate the sound generation time S[n+1] at which the automatic performance instrument 30 should sound the (n+1)th music note.

Equation $$S[n+1] = T[n] + \frac{x[n+1]-x[n]}{v[n]} \tag{7}$$

The dynamic model has the advantage that it is possible to predict the sound generation time S corresponding to the position on the musical score. In addition, the dynamic model has the advantage that, in principle, parameter tuning (learning) in advance is not necessary.

In the ensemble system 1, there are cases in which there is a desire to adjust the degree of synchronization between the performance of the performer P and the performance of the automatic performance instrument 30. In other words, in the ensemble system 1, there are cases in which there is a desire to adjust the degree to which the performance of the automatic performance instrument 30 follows the performance of the performer P.

However, in the regression model according to the related technology, in order to respond to said desires, for example, when the degree of synchronization between the performance of the performer P and the performance of the automatic performance instrument 30 is variously changed, it becomes necessary to conduct preliminary learning regarding each of various degrees of synchronization that could be changed. In this case, there is the problem that the processing load increases during preliminary learning.

In addition, in order to respond to said desires with regard to the dynamic model according to the related technology, for example, the degree of synchronization is adjusted according to the process noise e[n], or the like. However, even in this case, the sound generation time S[n+1] is calculated based on the observation value according to the sound generated by the performer P, such as the sound generation time T[n], or the like; therefore, there are cases in which the degree of synchronization cannot be flexibly adjusted.

In contrast, the prediction module 133 according to the present embodiment predicts the sound generation time S[n+1] by means of a mode that is capable of more flexibly adjusting the degree to which the performance of the automatic performance instrument 30 follows the performance of the performer P compared with the related technology, while being based on the dynamic model according to the related technology. One example of the process of the prediction module 133 according to the present embodiment will be described below.

The prediction module 133 according to the present embodiment updates the state vector that represents the state of the dynamic system relating to the performance of the performer P (referred to as "state vector Vu") and the state vector that represents the state of the dynamic system relating to the performance of the automatic performance instrument 30 (referred to as "state vector Va"). Here, the state vector Vu includes, as elements, the performance position xu, which is the state variable that represents an estimated position of the performance of the performer P on the musical score, and the velocity vu, which is the state variable that represents the estimated value of the velocity of the performance of the performer P on the musical score. Here, the state vector Va includes, as elements, the performance position xa, which is the state variable that represents an estimated value of the position of the performance by the automatic performance instrument 30 on the musical score, and the velocity va, which is the state variable that represents the estimated value of the velocity of the performance by the automatic performance instrument 30 on the musical score. Hereinbelow, the state variables included in the state vector Vu (performance position xu and velocity vu) are collectively referred to as the "first state variables," and the state variables included in the state vector Va (performance position xa and velocity va) are collectively referred to as the "second state variables."

As an example, the prediction module 133 according to the present embodiment updates the first state variables and the second state variables using the state transition model shown in the following equations (8) to (11). Of the foregoing, the first state variables are updated in the state transition model by means of the following equations (8) and (11). These equations (8) and (11) embody equation (4). In addition, the second state variables are updated in the state transition model by means of the following equations (9) and (10) instead of the equation (4) described above.

Equation $$xu[n]=xu[n-1]+(T[n]-T[n-1])vu[n-1]+exu[n] \tag{8}$$

Equation $$xa[n]=\gamma[n]\{xa[n-1]+(T[n]-T[n-1])va[n-1]+exa[n]\}+(1-\gamma[n])\{xu[n-1]+(T[n]-T[n-1])vu[n-1]+exu[n]\} \tag{9}$$

Equation $$va[n]=va[n-1]+eva[n] \tag{10}$$

Equation $$vu[n]=vu[n-1]+evu[n] \tag{11}$$

Here, the process noise exu[n] occurs when the performance position xu[n] is updated according to the state transition model, the process noise exa[n] occurs when the performance position xa[n] is updated according to the state transition model, the process noise eva[n] is noise that occurs when the velocity va[n] is updated according to the state transition model, and the process noise evu[n] is noise that occurs when the velocity vu[n] is updated according to the state transition model. In addition, a coupling coefficient γ[n] is a real number that satisfies 0≤γ[n]≤1. In equation (9), the value "1−γ[n]" that is multiplied by the performance position xu, which is a first state variable, is one example of a "following coefficient."

As shown in equations (8) and (11), the prediction module 133 according to the present embodiment predicts the performance position xu[n] and the velocity vu[n], which are the first state variables, using the performance position xu[n−1] and the velocity vu[n−1], which are the first state variables. On the other hand, as shown in equations (9) and (10), the prediction module 133 according to the present embodiment predicts the performance position xa[n] and the velocity va[n], which are the second state variables, using the performance position xu[n−1] and the velocity vu[n−1], which are the first state variables, and/or the performance position xa[n−1] and the velocity va[n−1], which are the second state variables.

In addition, the prediction module 133 according to the present embodiment uses the state transition model shown in equations (8) and (11) and the observation model shown in equation (5), when updating the performance position xu[n] and the velocity vu[n], which are the first state variables. On the other hand, the prediction module 133 according to the present embodiment uses the state transition model shown in equations (9) and (10) but does not use the observation model, when updating the performance position xa[n] and the velocity va[n], which are the second state variables.

As shown in equation (9), the prediction module 133 according to the present embodiment predicts the performance position xa[n], which is a second state variable, based on the value obtained by multiplying the following coefficient (1−γ[n]) by a first state variable (for example, the performance position xu[n−1]), and the value obtained by multiplying the coupling coefficient γ[n] by a second state variable (for example, the performance position xa[n−1]). Accordingly, the prediction module 133 according to the present embodiment can adjust the degree to which the performance by the automatic performance instrument 30 follows the performance of the performer P by means of adjusting the value of the coupling coefficient γ[n]. In other words, the prediction module 133 according to the present embodiment can adjust the degree of synchronization between the performance of the performer P and the performance of the automatic performance instrument 30 by means of adjusting the value of the coupling coefficient γ[n]. If the following coefficient (1−γ[n]) is set to a large value, it is possible to increase the ability of the automatic performance instrument 30 to follow the performance with respect to the performance by the performer P, compared to when a small value is set. In other words, if the coupling coefficient γ[n] is set to a large value, it is possible to decrease the ability of the performance to be followed by the automatic performance instrument 30 with respect to the performance by the performer P, compared to when a small value is set.

As described above, according to the present embodiment, it is possible to adjust the degree of synchronization between the performance of the performer P and the performance of the automatic performance instrument 30 by means of changing the value of a single coefficient, the coupling coefficient γ. In other words, according to the present embodiment, it is possible to adjust the mode of the sound generation by the automatic performance instrument 30 in the performance, based on the following coefficient (1−γ[n]).

The prediction module 133 includes a reception module 1331, a coefficient determination module 1332, a state variable updating module 1333, and a predicted time calculating module 1334.

The reception module 1331 receives an input of the observation value relating to the timing of the performance. In the present embodiment, the observation value relating to the timing of the performance includes a first observation value that relates to the performance timing by the performer P. However, in addition to the first observation value, the observation value relating to the timing of the performance can include a second observation value that relates to the performance timing by the automatic performance instrument 30. Here, the first observation value is a collective term for the sound generation position u that relates to the performance of the performer P (hereinafter referred to as "sound generation position uu") and the sound generation time T. In addition, the second observation value is a collective term for the sound generation position u that relates to the performance of the automatic performance instrument 30 (hereinafter referred to as "sound generation position ua") and the sound generation time S. In addition to the observation value relating to the timing of the performance, the reception module 1331 receives an input of an observation value accompanying the observation value relating to the timing of the performance. In the present embodiment, the accompanying observation value is the observation noise q that relates to the performance of the performer P. The reception module 1331 stores the received observation value in the storage device 12.

The coefficient determination module 1332 determines the value of the coupling coefficient γ. The value of the coupling coefficient γ is set in advance in accordance with, for example, the performance position on the musical score. The storage device 12 according to the present embodiment stores profile information, in which, for example, the performance position on the musical score and the value of the coupling coefficient γ are associated with each other. Then, the coefficient determination module 1332 refers to the profile information that is stored in the storage device 12 and acquires the value of the coupling coefficient γ that corresponds to the performance position on the musical score. Then, the coefficient γ determination module 1332 sets the value acquired from the profile information as the value of the coupling coefficient γ.

The coefficient determination module 1332 can set the value of the coupling coefficient γ to a value corresponding, for example, to an instruction from an operator of the timing control device 10 (one example of a "user"). In this case, the timing control device 10 has a UI (User Interface) for receiving an operation that indicates the instruction from the operator. This UI can be a software UI (UI via a screen displayed by software) or a hardware UI (fader, or the like). In general, the operator is different from the performer P, but the performer P can be the operator.

The state variable updating module 1333 updates the state variables (the first state variables and the second state variables). Specifically, the state variable updating module 1333 according to the present embodiment updates the state variables using the above-described equation (5) and equations (8) to (11). More specifically, the state variable updating module 1333 according to the present embodiment updates the first state variables using the equations (5), (8), and (11), and updates the second state variables using the equations (9) and (10). Then, the state variable updating module 1333 outputs the updated state variables.

As is clear from the description above, the state variable updating module 1333 updates the second state variables based on the coupling coefficient γ that has the value determined by the coefficient determination module 1332. In other words, the state variable updating module 1333 updates the second state variables based on the following coefficient (1−γ[n]). Accordingly, the timing control device 10 according to the present embodiment adjusts the mode of the sound generation by the automatic performance instrument 30 in the performance, based on the following coefficient (1−γ[n]).

The predicted time calculating module 1334 calculates the sound generation time S[n+1], which is the time of the next sound generation by the automatic performance instrument 30, using the updated state variables.

Specifically, first, the predicted time calculating module 1334 applies the state variables updated by the state variable updating module 1333 to the equation (6) to calculate the performance position x[t] at a future time t. More specifically, the predicted time calculating module 1334 applies the performance position xa[n] and the velocity va[n] updated by the state variable updating module 1333 to the equation (6) to calculate the performance position x[n+1] at the future time t. Next, the predicted time calculating module 1334 uses the equation (7) to calculate the sound generation time S[n+1] at which the automatic performance instrument 30 should sound the (n+1)th music note. The predicted time calculating module 1334 then outputs the signal (one example of a "timing designation signal") indicating the sound generation time S[n+1] obtained by the calculation.

The output module 15 outputs the command signal that indicates the performance command corresponding to the music note that the automatic performance instrument 30 should sound next to the automatic performance instrument 30, in accordance with the sound generation time S[n+1], which indicates the timing designation signal that is input from the prediction module 133. The timing control device 10 has an internal clock (not shown) and measures the time. The performance command is described according to a designated data format. The designated data format is, for example, MIDI. The performance command includes, for example, a note-on message, a note number, and velocity.

The display device 16 displays information relating to the estimation result of the performance position, and information relating to a prediction result of the next sound generation time by the automatic performance instrument 30. The information relating to the estimation result of the performance position includes, for example, at least one or more of the musical score, a frequency spectrogram of the sound signal that is input, or a probability distribution of the estimated value of the performance position. The information relating to the prediction result of the next sound generation time includes, for example, the state variable. By means of the display of the information relating to the estimation result of the performance position and the information relating to the prediction result of the next sound generation time by the display device 16, it is possible for the operator of the timing control device 10 to ascertain the operating state of the ensemble system 1.

As described above, the timing generation module 100 includes the first cutoff module 11, the second cutoff module 132, and the third cutoff module 14. Hereinbelow, there are cases in which the first cutoff module 11, the second cutoff module 132, and the third cutoff module 14 are collectively referred to as the "cutoff modules."

The cutoff modules can be brought into either a state in which the signal that is output by a compositional element that is provided in a preceding stage of the cutoff modules is transmitted to a compositional element that is provided in a subsequent stage of the cutoff modules (hereinafter referred to as the "transmitting state"), or a state in which the transmission of the signal is cut off (hereinafter referred to as the "cutoff state"). Hereinbelow, the transmitting state and the cutoff state can be collectively referred to as the "operating state."

Specifically, the first cutoff module 11 performs input switching and can be brought into either the transmitting state (input transmitting state) for transmitting the sound signal that is output by the sensor group 20 to the timing output module 13, or the cutoff state (input cutoff state) in which the transmission of the sound signal to the timing output module 13 is cut off.

In addition, the second cutoff module 132 performs signal switching and can be brought into either the transmitting state (signal transmitting state) for transmitting the observation value that is output by the estimation module 131 to the prediction module 133, or the cutoff state (signal cutoff state) in which the transmission of the observation value to the prediction module 133 is cut off.

Furthermore, the third cutoff module 14 performs output switching and can be brought into either the transmitting state (output transmitting state) for transmitting the timing designation signal that is output by the timing output module 13 to the output module 15, or the cutoff state (output cutoff state) in which the transmission of the timing designation signal to the output module 15 is cut off.

The cutoff modules can supply operating state information which indicates the operating state of the cutoff modules to the compositional element that is provided in the subsequent stage of the cutoff modules.

When the first cutoff module 11 is in the transmitting state and the sound signal that is output by the sensor group 20 is input thereto, the timing generation module 100 operates according to the first generation mode in which the timing designation signal is generated based on the input sound signal. On the other hand, when the first cutoff module 11 is in the cutoff state and the input of the sound signal that is output by the sensor group 20 is cut off, the timing generation module 100 operates according to the second generation mode in which the timing designation signal is generated without using the sound signal.

In the timing generation module 100, when the first cutoff module 11 is in the cutoff state and the input of the sound signal that is output by the sensor group 20 is cut off, the estimation module 131 generates a pseudo-observation value and outputs the pseudo-observation value. Specifically, in the case that the input of the sound signal is cut off, the estimation module 131 generates the pseudo-observation value based on the result of a past calculation by the prediction module 133, or the like. More specifically, the estimation module 131 generates the pseudo-observation value based on, for example, a clock signal that is output from a clock signal generation unit (not shown) that is provided in the timing control device 10, and the predicted value of the sound generation position u, the velocity v, etc., that were calculated in the past in the prediction module 133, and outputs the generated pseudo-observation value.

In the timing generation module 100, when the second cutoff module 132 is in the cutoff state and the input of the observation value that is output by the estimation module 131 (or the pseudo-observation value) is cut off, the prediction module 133 generates a pseudo-predicted value of the sound generation time S[n+1] instead of predicting the sound generation time based on the observation value, and outputs the timing designation signal that indicates the generated pseudo-predicted value. Specifically, in the case that the input of the observation value (or the pseudo-observation value) is cut off, the prediction module 133 generates the pseudo-predicted value based on the result of a past calculation by the prediction module 133, or the like. More specifically, the prediction module 133 generates the pseudo-predicted value based on, for example, the clock signal and the velocity v, the sound generation time S, etc., that were previously calculated by the prediction module 133, and outputs the generated pseudo-predicted value.

When the third cutoff module 14 is in the transmitting state and the timing designation signal that is output by the timing generation module 100 is input thereto, the output module 15 operates according to the first output mode in which the command signal is output based on the input timing designation signal. On the other hand, when the third cutoff module 14 is in the cutoff state and the input of the timing designation signal that is output by the timing generation module 100 is cut off, the output module 15 operates according to the second output mode in which the command signal is output based on the timing of the sound generation that is designated by the music data, without using the timing designation signal.

In the case that the timing control device 10 carries out the process for predicting the sound generation time S[n+1] based on the sound signal that is input to the timing control device 10, there are cases in which the process for predicting the sound generation time S[n+1] becomes unstable due to, for example, an unexpected "deviation" in the timing at which the sound signal is input, or due to noise, etc., that is superimposed on the sound signal. Furthermore, in a state in which the process for predicting the sound generation time S[n+1] is unstable, if the process is continued, there is the possibility that the operation of the timing control device 10 will stop. However, for example, during a concert, etc., it is necessary to avoid the stopping of the operation of the timing control device 10 and to prevent the performance by the automatic performance instrument 30 based on the performance command from the timing control device 10 from becoming unstable, even when the process for predicting the sound generation time S[n+1] becomes unstable.

In contrast, in the present embodiment, because the timing control device 10 comprises the first cutoff module 11, the second cutoff module 132, and the third cutoff module 14, it is possible to prevent the process for predicting the sound generation time S[n+1] based on the sound signal from continuing in an unstable state. It is thereby possible to avoid the stopping of the operation of the timing control device 10 and to prevent the performance by the automatic performance instrument 30 based on the performance command from the timing control device 10 from becoming unstable.

Figure 3:
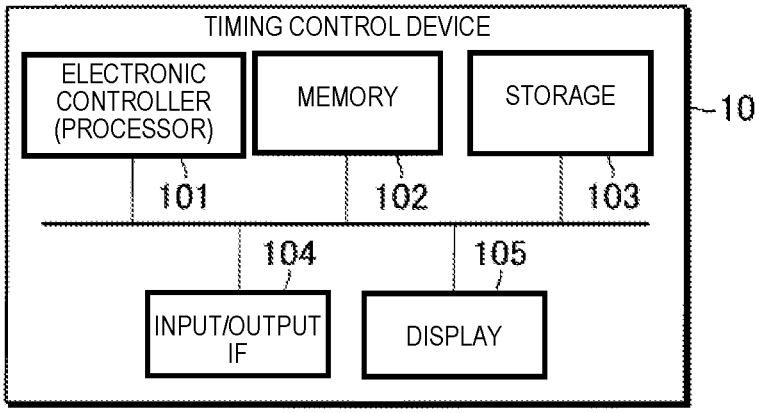
FIG. 3 is a block diagram illustrating a hardware configuration of the timing control device 10.

FIG. 3 is a block diagram illustrating a hardware configuration of the timing control device 10. The timing control device 10 is a computer device comprising an electronic controller (processor) 101, a memory 102, a storage 103, an input/output IF 104, and a display 105.

The electronic controller 101 is, for example, a CPU (Central Processing Unit), and controls each module and device of the timing control device 10. The electronic controller 101 includes at least one processor. The term "electronic controller" as used herein refers to hardware that executes software programs. The electronic controller 101 can be configured to comprise, instead of the CPU or in addition to the CPU, programmable logic devices such as a DSP (Digital Signal Processor), an FPGA (Field Programmable Gate Array), and the like. In addition, the electronic controller 101 can include a plurality of CPUs (or a plurality of programmable logic devices). The memory 102 is a non-transitory storage medium, and is, for example, a nonvolatile memory such as a RAM (Random Access Memory). The memory 102 functions as a work area when the processor of the electronic controller 101 executes a control program, which is described further below. The storage 103 is a non-transitory storage medium, and is, for example, a nonvolatile memory such as an EEPROM (Electrically Erasable Programmable Read-Only Memory). The storage 103 stores various programs, such as a control program, for controlling the timing control device 10, as well as various data. The input/output IF 104 is an interface for inputting signals from or outputting signals to other devices. The input/output IF 104 includes, for example, a microphone input and a MIDI output. The display 105 is a device for outputting various information, and includes, for example, an LCD (Liquid Crystal Display).

The processor of the electronic controller 101 executes the control program that is stored in the storage 103 and operates according to the control program to thereby function as the timing generation module 100 and the output module 15. One or both of the memory 102 and the storage 103 can function as the storage device 12. The display 105 can function as the display device 16.

2. Operation

2-1. Normal Operation

The operation of the timing control device 10 in a case in which the cutoff module is in the transmitting state will be described below.

Figure 4:
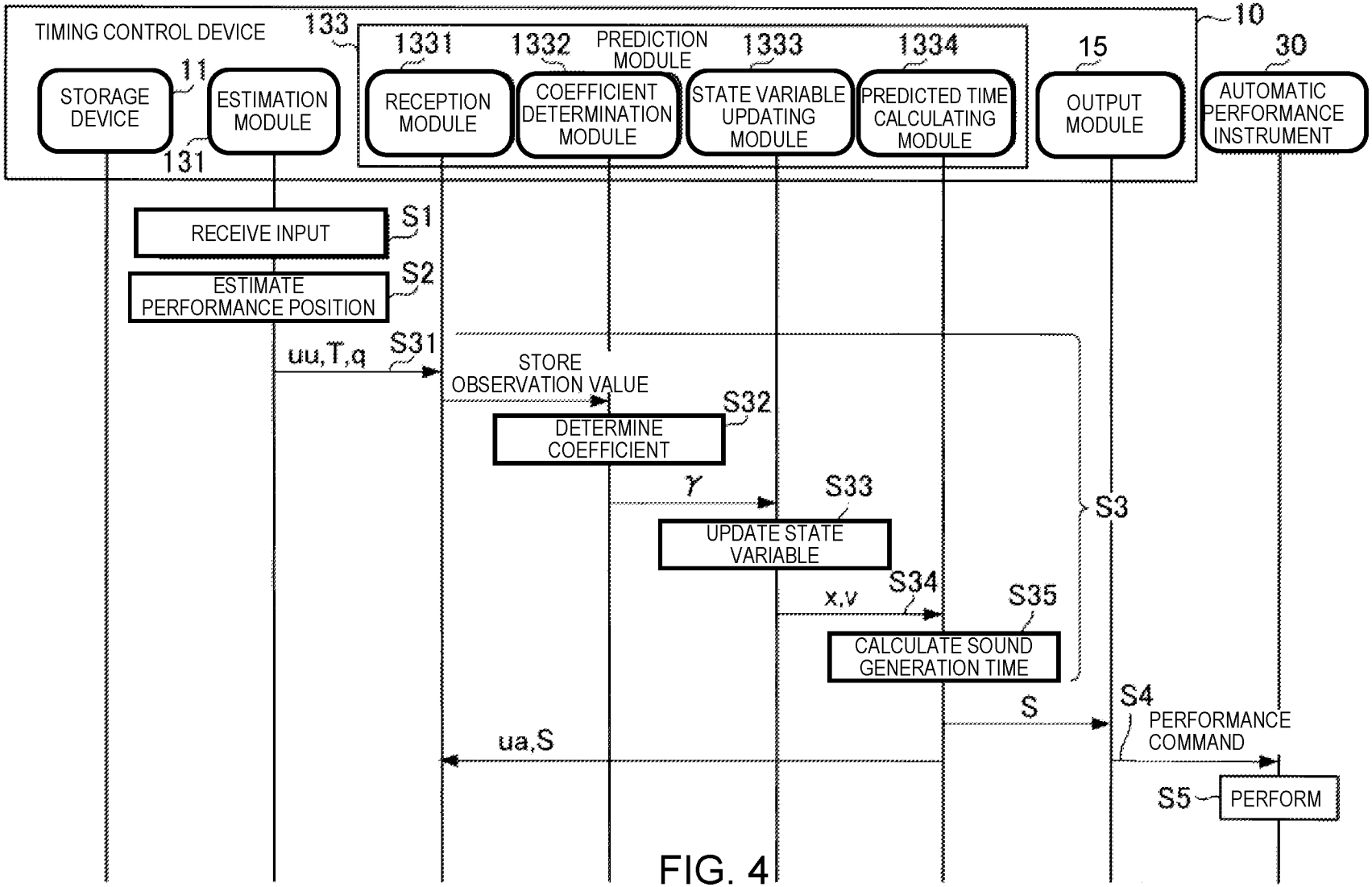
FIG. 4 is a sequence chart illustrating an operation of the timing control device 10.

FIG. 4 is a sequence chart illustrating the operation of the timing control device 10 in a case in which the cutoff module is in the transmitting state. The sequence chart of FIG. 4 is started, for example, when triggered by the processor of the electronic controller 101 activating the control program.

In Step S1, the estimation module 131 receives the input of the sound signal. When the sound signal is an analog signal, for example, the sound signal is converted to a digital signal by a D/A converter (not shown) that is provided in the timing control device 10, and the sound signal that has been converted into a digital signal is input to the estimation module 131.

In Step S2, the estimation module 131 analyzes the sound signal and estimates the performance position on the musical score. The process relating to Step S2 is carried out, for example, in the following manner. In the present embodiment, the transition of the performance position on the musical score (musical score time series) is described using a probability model. By using the probability model to describe the musical score time series, it is possible to deal with such problems as mistakes in the performance, omission of repeats in the performance, fluctuation in the tempo of the performance, and uncertainty in the pitch or the sound generation time in the performance. An example of the probability model that describes the musical score time series that can be used is the hidden Semi Markov model (Hidden Semi-Markov Model, HSMM). The estimation module 131 obtains the frequency spectrogram by, for example, dividing the sound signal into frames and applying a constant-Q transform. The estimation module 131 extracts the onset time and the pitch from this frequency spectrogram. For example, the estimation module 131 successively estimates the distribution of the stochastic estimated values which indicate the performance position on the musical score by means of Delayed-decision, and outputs a Laplace approximation of the distribution and one or more statistics, at the point in time in which the peak of the distribution passes the position that is considered as the beginning of the musical score. Specifically, when the sound generation that corresponds to the nth music note that exists on the music data is detected, the estimation module 131 outputs the sound generation time T[n] at which the sound generation is detected, and the average position on the musical score in the distribution that indicates the stochastic position of the sound generation on the musical score, and the variance. The average position on the musical score is the estimated value of the sound generation position u[n], and the variance is the estimated value of the observation noise q[n]. Details of the estimation of the sound generation position is disclosed in, for example, Japanese Laid-Open Patent Application No. 2015-79183.

Figure 5:
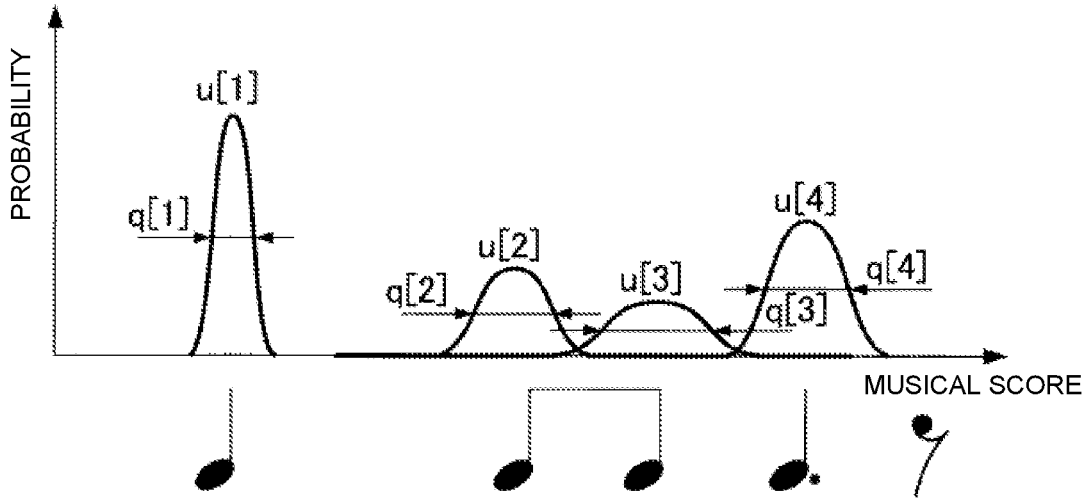
FIG. 5 is an explanatory view for explaining a sound generation position u[n] and an observation noise q[n].

FIG. 5 is an explanatory view for explaining the sound generation position u[n] and the observation noise q[n]. In the example shown in FIG. 5, a case in which four music notes are included in one bar on the musical score is illustrated. The estimation module 131 calculates the probability distributions P[1]-P[4], which correspond one-to-one to four generated sounds corresponding to four music notes included in the one bar. Then, the estimation module 131 outputs the sound generation time T[n], the sound generation position u[n], and the observation noise q[n], based on the calculation result.

FIG. 4 is referred to again. In Step S3, the prediction module 133 predicts the next sound generation time by the automatic performance instrument 30 using the estimated value that is supplied from the estimation module 131 as the observation value. One example of the details of the process in Step S3 will be described below.

In Step S3, the reception module 1331 receives input of the observation values (first observation values) such as the sound generation position uu, the sound generation time T, and the observation noise q, supplied from the estimation module 131 (Step S31). The reception module 1331 stores these observation values in the storage device 12.

In Step S3, the coefficient determination module 1332 determines the value of the coupling coefficient γ that is used to update the state variable (Step S32). Specifically, the coefficient determination module 1332 refers to the profile information that is stored in the storage device 12, acquires the value of the coupling coefficient γ that corresponds to the current performance position on the musical score, and sets the acquired value to the coupling coefficient γ. As a result, it becomes possible to adjust the degree of synchronization between the performance of the performer P and the performance of the automatic performance instrument 30 in accordance with the performance position on the musical score. That is, the timing control device 10 according to the present embodiment is capable of causing the automatic performance instrument 30 to execute an automatic performance that follows the performance of the performer P in certain portions of the music piece, and to execute an independent automatic performance independently of the performance of the performer P in other portions of the music piece. Accordingly, the timing control device 10 according to the present embodiment is able to impart a human-like quality to the performance by the automatic performance instrument 30. For example, when the tempo of the performance of the performer P is clear, the timing control device 10 according to the present embodiment can cause the automatic performance instrument 30 to execute the automatic performance at a tempo at which the ability of the performer P to follow the tempo of the performance is greater than one's ability to follow the tempo of the performance that has been set in advance by the music data. Additionally, for example, when the tempo of the performance of the performer P is not clear, the timing control device 10 according to the present embodiment can cause the automatic performance instrument 30 to execute the automatic performance at a tempo at which one's ability to follow the tempo of the performance that has been set in advance by the music data is greater than the ability of the performer P to follow the tempo of the performance.

In Step S3, the state variable updating module 1333 updates the state variables using the input observation value (Step S33). As described above, in Step S33, the state variable updating module 1333 updates the first state variables using the equations (5), (8), and (11), and updates the second state variables using the equations (9) and (10). In addition, in Step S33, the state variable updating module 1333 updates the second state variables based on the following coefficient (1−γ[n]), as shown in equation (9).

In Step S3, the state variable updating module 1333 outputs the state variables updated in Step S33 to the predicted time calculating module 1334 (Step S34). Specifically, the state variable updating module 1333 according to the present embodiment outputs the performance position xa[n] and the velocity va[n] updated in Step S33 to the predicted time calculating module 1334.

In Step S3, the predicted time calculating module 1334 applies the state variables that are input from the state variable updating module 1333 to equations (6) and (7) and calculates the sound generation time S[n+1] at which the automatic performance instrument 30 should sound the (n+1)th music note (step S35). Specifically, the predicted time calculating module 1334 calculates the sound generation time S[n+1] based on the performance position xa[n] and the velocity va[n] which are input from the state variable updating module 1333 in Step S35. The predicted time calculating module 1334 then outputs the timing designation signal indicating the sound generation time S[n+1] obtained by the calculation.

When the sound generation time S[n+1] that is input from the prediction module 133 arrives, the output module 15 outputs the command signal that indicates the performance command corresponding to the (n+1)th music note that the automatic performance instrument 30 should sound next to the automatic performance instrument 30 (Step S4). In practice, when delays in the process in the output module 15 and the automatic performance instrument 30 are taken into consideration, it is necessary to output the performance command at a timer that is earlier than the sound generation time S[n+1] that is predicted by the prediction module 133, but an explanation thereof is omitted here. The automatic performance instrument 30 emits a sound in accordance with the performance command that is supplied from the timing control device 10 (Step S5).

The prediction module 133 determines whether or not the performance has ended at a designated timing. Specifically, the prediction module 133 determines the end of the performance based on, for example, the performance position that is estimated by the estimation module 131. When the performance position reaches a designated end point, the prediction module 133 determines that the performance has ended. If the prediction module 133 determines that the performance has ended, the timing control device 10 ends the process shown in the sequence chart of FIG. 4. On the other hand, if the prediction module 133 determines that the performance has not ended, the timing control device 10 and the automatic performance instrument 30 repeatedly execute the process of steps S1 to S5.

2-2. Operation of the Cutoff Module

Next, the operation of the cutoff module will be described.

Figure 6:
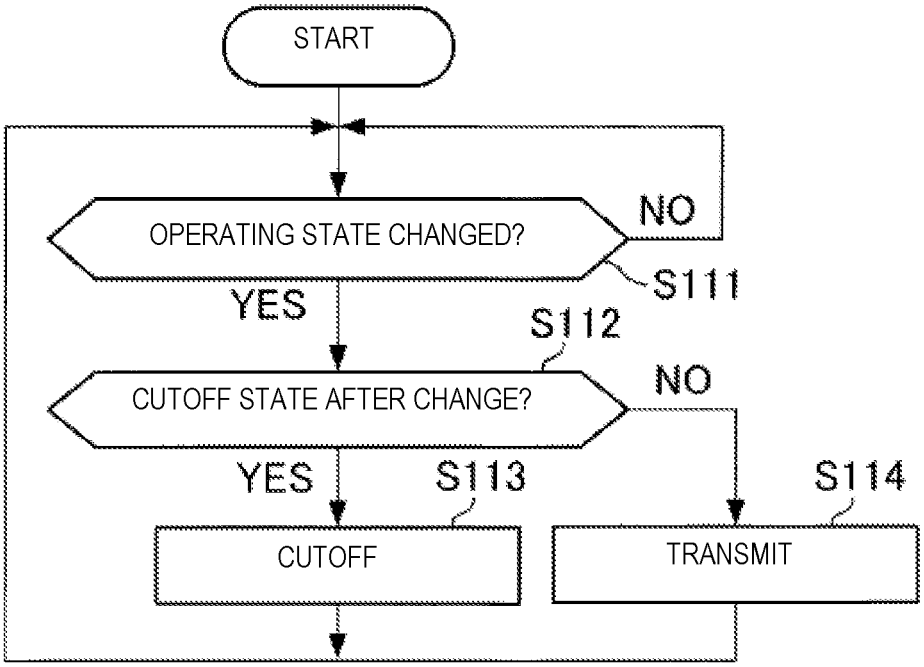
FIG. 6 is a flowchart illustrating an operation of a first cutoff unit 11.

FIG. 6 is a flowchart illustrating the operation of a first cutoff module 11. In Step S111, the first cutoff module 11 determines whether or not the operating state of the first cutoff module 11 has been changed. The operating state of the first cutoff module 11 is changed based on, for example, a command from the operator of the timing control device 10.

Then, if the operating state of the first cutoff module 11 has been changed (S111: YES), the first cutoff module 11 advances the process to Step S112. Also, if the operating state of the first cutoff module 11 has not been changed (S111: NO), the first cutoff module 11 advances the process to Step S111 in order to stand by until the operating state of the first cutoff module 11 is changed.

In Step S12, the first cutoff module 11 determines whether or not the operating state of the first cutoff module 11 after the change is the cutoff state. If the operating state after the change is the cutoff state (S112: YES), the first cutoff module 11 advances the process to Step S113. If the operating state after the change is the transmitting state (S112: NO), the first cutoff module 11 advances the process to Step S114.

In Step S13, the first cutoff module 11 cuts off the transmission of the sound signal to the timing output module 13 (estimation module 131). In this case, the first cutoff module 11 can notify the timing output module 13 of operating state information that indicates that the operating state of the first cutoff module 11 is the cutoff state. Then, if the operating state of the first cutoff module 11 has been changed to the cutoff state, the estimation module 131 stops the generation of the observation value based on the sound signal and starts the generation of the pseudo-observation value that is not based on the sound signal.

In Step S114, the first cutoff module 11 resumes the transmission of the sound signal to the timing output module 13 (estimation module 131). In this case, the first cutoff module 11 can notify the timing output module 13 of the operating state information that indicates that the operating state of the first cutoff module 11 is the transmitting state. Then, if the operating state of the first cutoff module 11 has been changed to the transmitting state, the estimation module 131 stops the generation of the pseudo-observation value and starts the generation of the observation value that is based on the sound signal.

Figure 7:
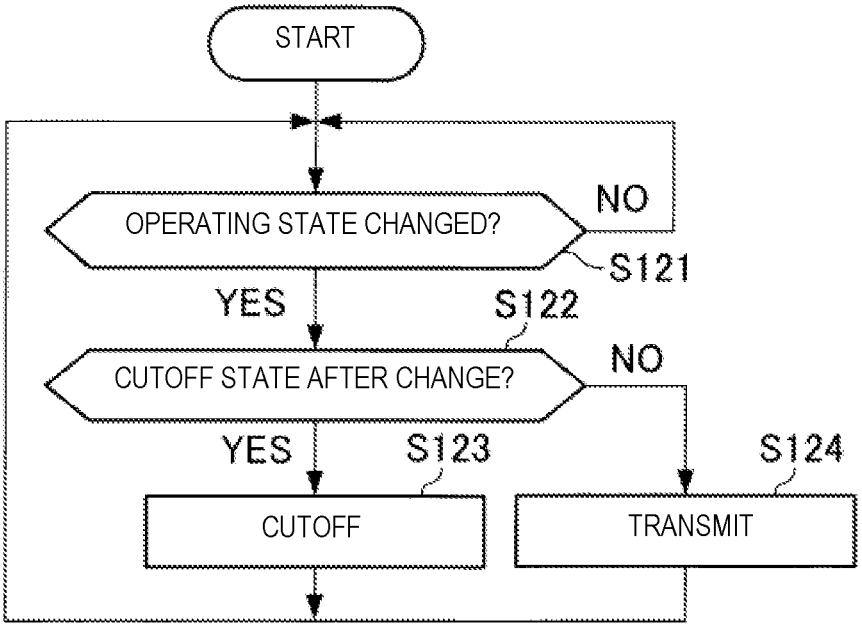
FIG. 7 is a flowchart illustrating an operation of a second cutoff unit 132.

FIG. 7 is a flowchart illustrating the operation of a second cutoff module 132. In Step S121, the second cutoff module 132 determines whether or not the operating state of the second cutoff module 132 has been changed.

The operating state of the second cutoff module 132 can be changed based on, for example, a command from the operator of the timing control device 10.

In addition, the operating state of the second cutoff module 132 can be changed based on the observation value (or the pseudo-observation value) that is output by the estimation module 131. For example, the second cutoff module 132 can be changed to the cutoff state when the probability distribution of the sound generation position u that is estimated by the estimation module 131 satisfies a designated condition. More specifically, the second cutoff module 132 can be changed to the cutoff state when the uncertainty of the sound generation position u on the musical score is somewhat high, for example, when the probability distribution of the sound generation position u on the musical score within a designated time range has two or more peaks, or, when the distribution of the estimated position of the sound generation position u on the musical score exceeds a designated value.

Then, if the operating state of the second cutoff module 132 has been changed (S121: YES), the second cutoff module 132 advances the process to Step S122. In addition, if the operating state of the second cutoff module 132 has not been changed (S121: NO), the second cutoff module 132 advances the process to Step S121 in order to stand by until the operating state of the second cutoff module 132 is changed.

In Step S122, the second cutoff module 132 determines whether or not the operating state of the second cutoff module 132 after the change is the cutoff state. If the operating state after the change is the cutoff state (S122: YES), the second cutoff module 132 advances the process to Step S123. If the operating state after the change is the transmitting state (S122: NO), the second cutoff module 132 advances the process to Step S124.

In Step S123, the second cutoff module 132 cuts off the transmission of the observation value to the prediction module 133. In this case, the second cutoff module 132 can notify the prediction module 133 of the operating state information that indicates that the operating state of the second cutoff module 132 is the cutoff state. Then, if the operating state of the second cutoff module 132 has been changed to the cutoff state, the prediction module 133 stops the process for predicting the sound generation time S[n+1] using the observation value (or the pseudo-observation value), and starts the generation of the pseudo-predicted value of the sound generation time S[n+1] without using the observation value (or the pseudo-observation value).

In Step S124, the second cutoff module 132 resumes the transmission of the observation value (or the pseudo-observation value) to the prediction module 133. In this case, the second cutoff module 132 can notify the prediction module 133 of the operating state information that indicates that the operating state of the second cutoff module 132 is the transmitting state. Then, if the operating state of the second cutoff module 132 has been changed to the transmitting state, the prediction module 133 stops the generation of the pseudo-predicted value of the sound generation time S[n+1] and starts the generation of the predicted value of the sound generation time S[n+1] based on the observation value (or the pseudo-observation value).

Figure 8:
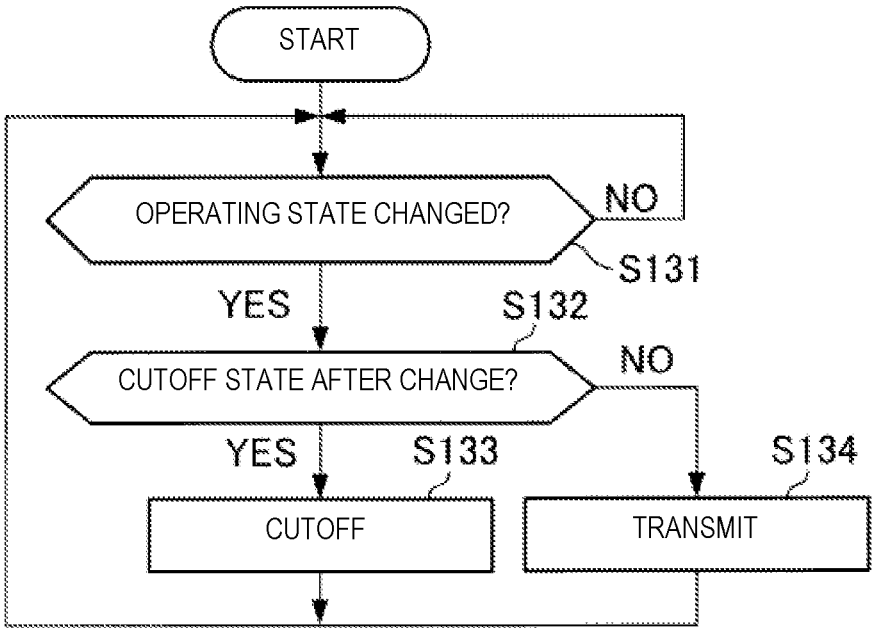
FIG. 8 is a flowchart illustrating an operation of a third cutoff unit 14.

FIG. 8 is a flowchart illustrating the operation of a third cutoff module 14. In Step S131, the third cutoff module 14 determines whether or not the operating state of the third cutoff module 14 has been changed.

The operating state of the third cutoff module 14 can be changed based on, for example, a command from the operator of the timing control device 10.

The operating state of the third cutoff module 14 can be changed based on, for example, the timing designation signal that is output by the timing output module 13. For example, the third cutoff module 14 can be changed to the cutoff state when the error between the sound generation time S[n+1] that is indicated by the timing designation signal and the timing of the sound generation of the (n+1)th music note that is indicated by the music data is above a designated allowable. In addition, the timing output module 13 can include, with respect to the timing designation signal, change instruction information that instructs the operator to change the operating state of the third cutoff module 14 to the cutoff state. In this case, the third cutoff module 14 can be changed to the cutoff state based on the change instruction information that is included in the timing designation signal.

Then, if the operating state of the third cutoff module 14 has been changed (S131: YES), the third cutoff module 14 advances the process to Step S132. In addition, if the operating state of the third cutoff module 14 has not been changed (S131: NO), the third cutoff module 14 advances the process to Step S131 in order to stand by until the operating state of the third cutoff module 14 is changed.

In Step S132, the third cutoff module 14 determines whether or not the operating state of the third cutoff module 14 after the change is the cutoff state. If the operating state after the change is the cutoff state (S132: YES), the third cutoff module 14 advances the process to Step S133. If the operating state after the change is the transmitting state (S132: NO), the third cutoff module 14 advances the process to Step S134.

In Step S133, the third cutoff module 14 cuts off the transmission of the timing designation signal to the output module 15. In this case, the third cutoff module 14 can notify the output module 15 of the operating state information that indicates that the operating state of the third cutoff module 14 is the cutoff state. Then, when the operating state of the third cutoff module 14 has been changed to the cutoff state, the output module 15 stops the operation according to the first output mode in which the command signal is output based on the timing designation signal and starts the operation according to the second output mode, where the command signal is output based on the timing of the sound generation that is designated by the music data.

In Step S134, the third cutoff module 14 cuts off the transmission of the timing designation signal to the output module 15. In this case, the third cutoff module 14 can notify the output module 15 of the operating state information that indicates that the operating state of the third cutoff module 14 is the transmitting state. Then, when the operating state of the third cutoff module 14 has been changed to the transmitting state, the output module 15 stops the operation according to the second output mode and starts the operation according to the first output mode.

2-3. Operation of the Timing Control Device

The operation of the timing control device 10 in a case in which the operating state of the cutoff module can be in both the transmitting state and the cutoff state will now be described.

Figure 9:
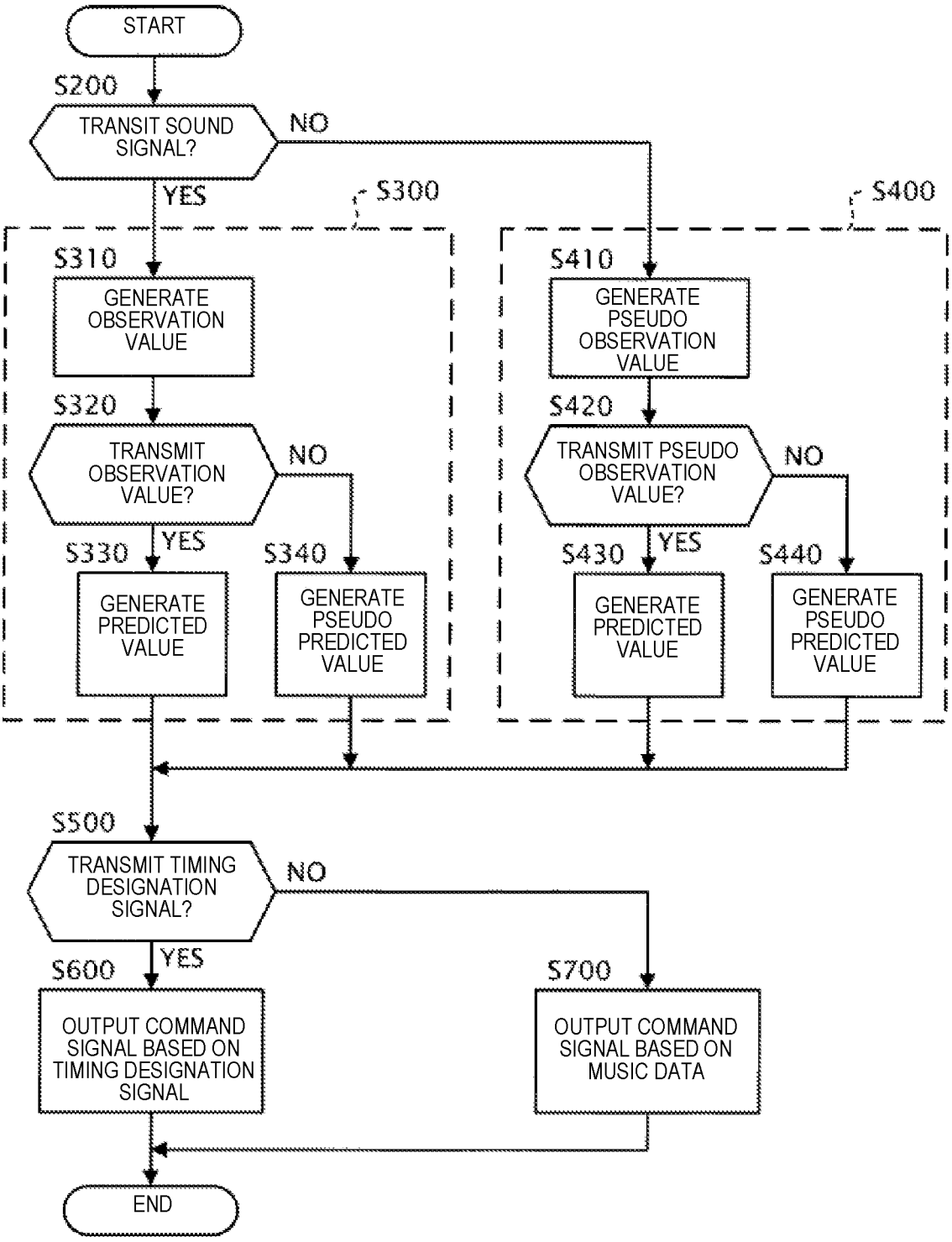
FIG. 9 is a flowchart illustrating the operation of the timing control device 10.

FIG. 9 is a flowchart illustrating the operation of the timing control device 10 for a case in which the operating state of the cutoff module can be in both of the transmitting state and the cutoff state. The process shown in the flowchart of FIG. 9 is started, for example, when triggered by the processor of the electronic controller 101 activating the control program. In addition, the process shown in the flowchart of FIG. 9 is executed each time the sound signal is supplied from the sensor group 20 until the performance ends.

As shown in FIG. 9, the timing generation module 100 determines whether or not the first cutoff module 11 is in the transmitting state for transmitting the sound signal (Step S200).

When the result of the determination in Step S200 is affirmative, that is, when the first cutoff module 11 is in the transmitting state, the timing generation module 100 generates the timing designation signal according to the first generation mode (Step S300).

Specifically, in Step S300, the estimation module 131 provided in the timing generation module 100 generates the observation value based on the sound signal (Step S310). The process of Step S310 is the same as the process of steps S1 and S2 described above. Next, the prediction module 133 provided in the timing generation module 100 determines whether or not the second cutoff module 132 is in the transmitting state for transmitting the observation value (Step S320). In the case that the determination result in Step S320 is affirmative, that is, when the second cutoff module 132 is in the transmitting state, the predicted value of the sound generation time S[n+1] is generated based on the observation value that is supplied from the estimation module 131, and the timing designation signal which indicates the predicted value is output (Step S330). On the other hand, in the case that the determination result in Step S320 is negative, that is, when the second cutoff module 132 is in the cutoff state, the pseudo-predicted value of the sound generation time S[n+1] is generated without using the observation value that is output by the estimation module 131, and the timing designation signal which indicates the pseudo-predicted value is output (Step S340).

On the other hand, when the result of the determination in Step S200 is negative, that is, when the first cutoff module 11 is in the cutoff state the timing generation module 100 generates the timing designation signal according to the second generation mode (Step S400).

Specifically, in Step S400, the estimation module 131 provided in the timing generation module 100 generates the pseudo-observation value without using the sound signal (Step S410). Next, the prediction module 133 provided in the timing generation module 100 determines whether or not the second cutoff module 132 is in the transmitting state transmitting the pseudo-observation value (Step S420). In the case that the determination result in Step S420 is affirmative, that is, when the second cutoff module 132 is in the transmitting state, the predicted value of the sound generation time S[n+1] is generated based on the pseudo-observation value that is supplied from the estimation module 131, and the timing designation signal which indicates the predicted value is output (Step S430). On the other hand, in the case that the determination result in Step S420 is negative, that is, when the second cutoff module 132 is in the cutoff state, the pseudo-predicted value of the sound generation time S[n+1] is generated without using the pseudo-observation value that is output by the estimation module 131, and the timing designation signal which indicates the pseudo-predicted value is output (Step S440).

As shown in FIG. 9, the output module 15 determines whether or not the third cutoff module 14 is in the transmitting state transmitting the timing designation signal (Step S500).

When the result of the determination in Step S500 is affirmative, that is, when the third cutoff module 14 is in the transmitting state, the output module 15 outputs the command signal according to the first output mode (Step S600). Specifically, the output module 15 outputs the command signal based on the timing designation signal that is supplied from the timing generation module 100 in Step S600. The process of Step S600 is the same as the process of Step S5 described above.

When the result of the determination in Step S500 is negative, that is, when the third cutoff module 14 is in the cutoff state, the output module 15 outputs the command signal according to the second output mode (Step S700).

Specifically, the output module 15 outputs the command signal based on the timing of the sound generation that is designated by the music data, without using the timing designation signal that is supplied from the timing generation module 100, in Step S700.

As described above, the timing generation module 100 according to the present embodiment is capable of generating the timing designation signal according to the first generation mode in which the timing designation signal is generated based on the sound signal that is output from the sensor group 20, and the second generation mode in which the timing designation signal is generated without using the sound signal that is output from the sensor group 20. As a result, according to the present embodiment, it is possible to prevent the performance of the automatic performance instrument 30 that is based on the timing designation signal that is output from the timing generation module 100 from becoming unstable, even when an unexpected "deviation" occurs in the timing at which the sound signal is output, or when noise is superimposed on the sound signal, for example.

In addition, the output module 15 according to the present embodiment is capable of outputting the command signal according to the first output mode in which the command signal is output based on the timing designation signal that is output from the timing generation module 100 and the second output mode in which the command signal is output without using the timing designation signal that is output from the timing generation module 100. As a result, according to the present embodiment, it is possible to prevent the performance of the automatic performance instrument 30 that is based on the command signal that is output from the output module 15 from becoming unstable, for example, even when the process in the timing generation module 100 is unstable.

3. Modified Examples

The present embodiment is not limited to the embodiment described above, and various modifications are possible. Several modified examples will be described below. Two or more of the following modified examples can be used in combination.

3-1. First Modified Example

The device to be the subject of the timing control by the timing control device 10 (hereinafter referred to as "control target device") is not limited to the automatic performance instrument 30. That is, the "event," the timing of which is predicted by the prediction module 133, is not limited to the sound generation by the automatic performance instrument 30. The control target device can be, for example, a device for generating images that change synchronously with the performance of the performer P (for example, a device that generates computer graphics that change in real time), or a display device (for example a projector or a direct view display) that changes the image synchronously with the performance of the performer P. In another example the control target device can be a robot that carries out an operation, such as dance, etc., synchronously with the performance of the performer P.

3-2. Second Modified Example

It is not necessary that the performer P be human. That is, the performance sound of another automatic performance instrument that is different from the automatic performance instrument 30 can be input into the timing control device 10. According to this example, in the ensemble of a plurality of automatic performance instruments, it is possible to cause the performance timing of one of the automatic performance instruments to follow the performance timing of the other automatic performance instruments in real time.

3-3. Third Modified Example

The numbers of the performers P and the automatic performance instruments 30 are not limited to those illustrated in the embodiment. The ensemble system 1 can include two or more of the performers P and/or of the automatic performance instruments 30.

3-4. Fourth Modified Example

The functional configuration of the timing control device 10 is not limited to that illustrated in the embodiment. A part of the functional elements illustrated in FIG. 2 can be omitted. For example, it is not necessary for the timing control device 10 to include the predicted time calculating module 1334. In this case, the timing control device 10 can simply output the state variables that have been updated by the state variable updating module 1333. In this case, the timing of the next event (for example, the sound generation time S[n+1]) can be calculated by a device other than the timing control device 10 into which the state variables that have been updated by the state variable updating module 1333 have been input. In addition, in this case, a process other than the calculation of the timing of the next event (for example, displaying an image that visualizes the state variables) can be carried out by the device other than the timing control device 10. In another example, it is not necessary that the timing control device 10 include the display device 16.

Additionally, the hardware configuration of the timing control device 10 is not limited to that illustrated in the embodiment. For example, the timing control device 10 can comprise a plurality of processors respectively having functions as the estimation module 131, the prediction module 133, and the output module 15. Furthermore, the timing control device 10 can have a plurality of hardware switches having functions as the first cutoff module 11, the second cutoff module 132, and the third cutoff module 14. That is, at least one or more of the first cutoff module 11, the second cutoff module 132, or the third cutoff module 14 can be a hardware switch.

3-5. Fifth Modified Example

In the embodiment and modified examples described above, the cutoff module switches the operating state based on the instruction from the operator or the signal that is input to the cutoff module, but the present embodiment is not limited to such a mode. It is sufficient if the cutoff module is able to switch the operating state based on the presence/absence of an event that causes the operation of the timing control device 10 to become unstable.

For example, the cutoff module can switch the operating state to the cutoff state when a power consumption amount by the timing control device 10 exceeds a designated value.

In addition, the cutoff module can switch the operating state to the cutoff state when a designated period of time has elapsed after the operating states of the other cutoff modules have been switched to the cutoff state.

3-6. Sixth Modified Example

In the embodiment and the modified examples described above, the timing control device 10 comprises the first cutoff module 11, the second cutoff module 132, and the third cutoff module 14, but the present embodiment is not limited to such a mode; it is sufficient if the timing control device 10 comprises at least one cutoff module, from among the cutoff module 11, the second cutoff module 132, and the third cutoff module 14.

Figure 10:
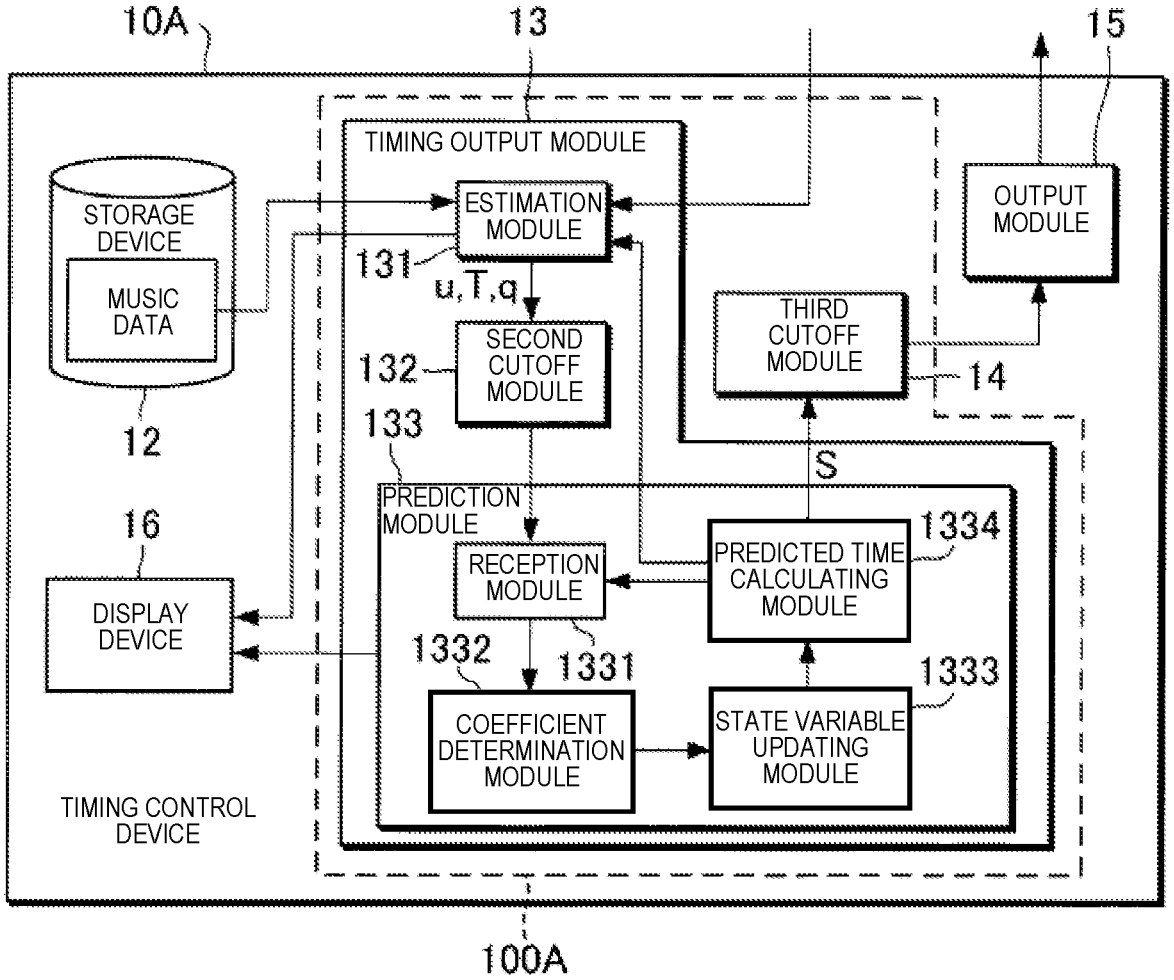
FIG. 10 is a block diagram illustrating a functional configuration of a timing control device 10A according to a sixth modified example.

FIG. 10 is a block diagram illustrating the functional configuration of a timing control device 10A according to one embodiment of the present modified example. The timing control device 10A is configured in the same manner as the timing control device 10 shown in FIG. 2, except for the inclusion of a timing generation module 100A instead of the timing generation module 100. In addition, the timing generation module 100A is configured in the same manner as the timing generation module 100 shown in FIG. 2, except for not including the first cutoff module 11.

Figure 11:
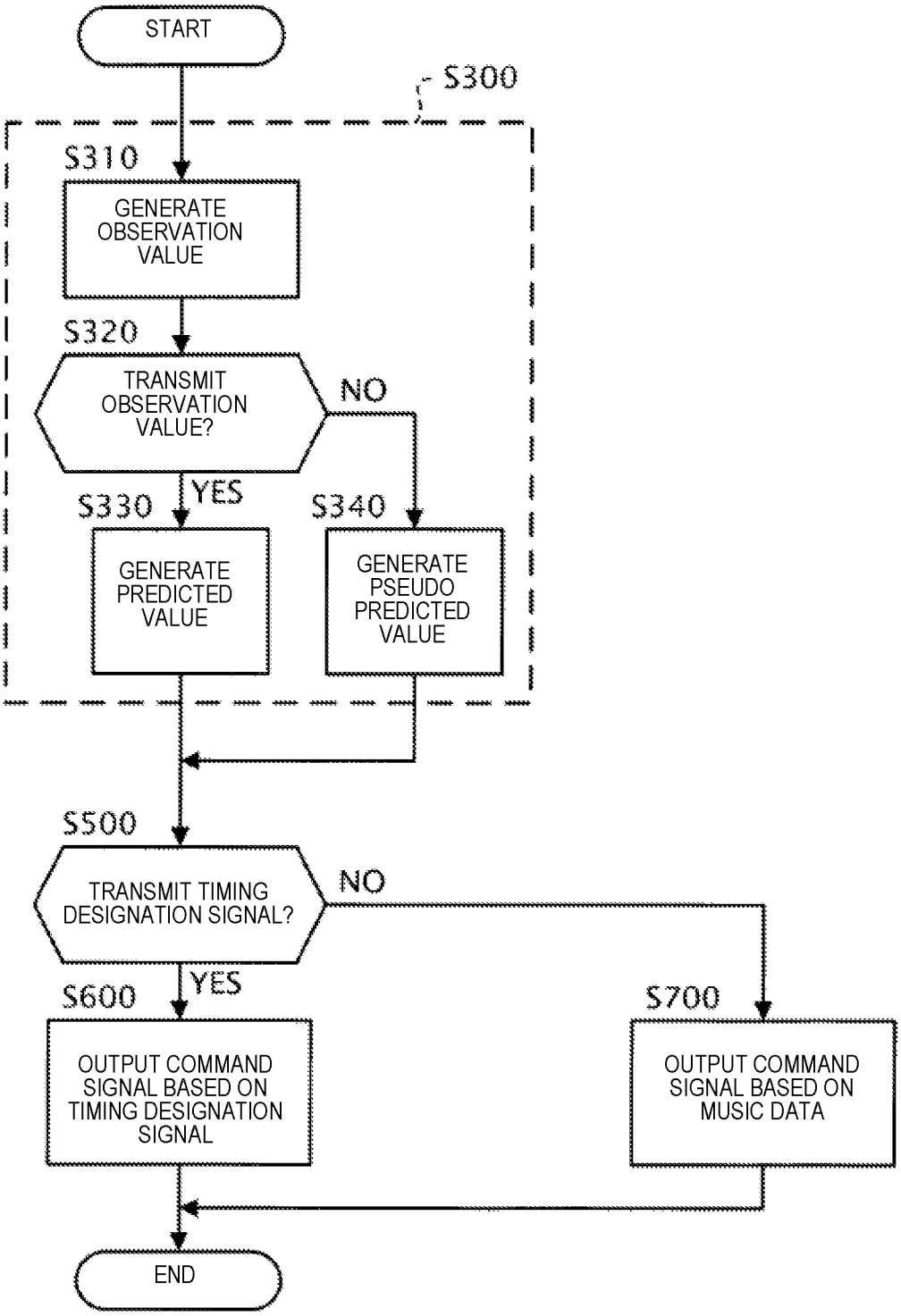
FIG. 11 is a flowchart illustrating an operation of the timing control device 10A according to the sixth modified example.

FIG. 11 is a flowchart illustrating the operation of the timing control device 10A. The flowchart shown in FIG. 11 is the same as the flowchart shown in FIG. 9, except for not having the Step S200 and the Step S400.

Since, even in the timing control device 10A such as the above, the output module 15 is capable of outputting the command signal according to the first output mode in which the command signal is output based on the timing designation signal that is output from the timing generation module 100A, and the second output mode in which the command signal is output without using the timing designation signal that is output from the timing generation module 100A, it is possible to prevent the performance of the automatic performance instrument 30 that is based on the command signal that is output from the output module 15 from becoming unstable, for example, even when the process in the timing generation module 100A is unstable.

The timing control device 10A shown in FIG. 10 comprises the second cutoff module 132, but such a configuration is merely one example; it is not necessary for the timing control device 10A to have the second cutoff module 132. In other words, in the flowchart shown in FIG. 11, it is not necessary that the process of steps S320 and S340 be executed.

Figure 12:
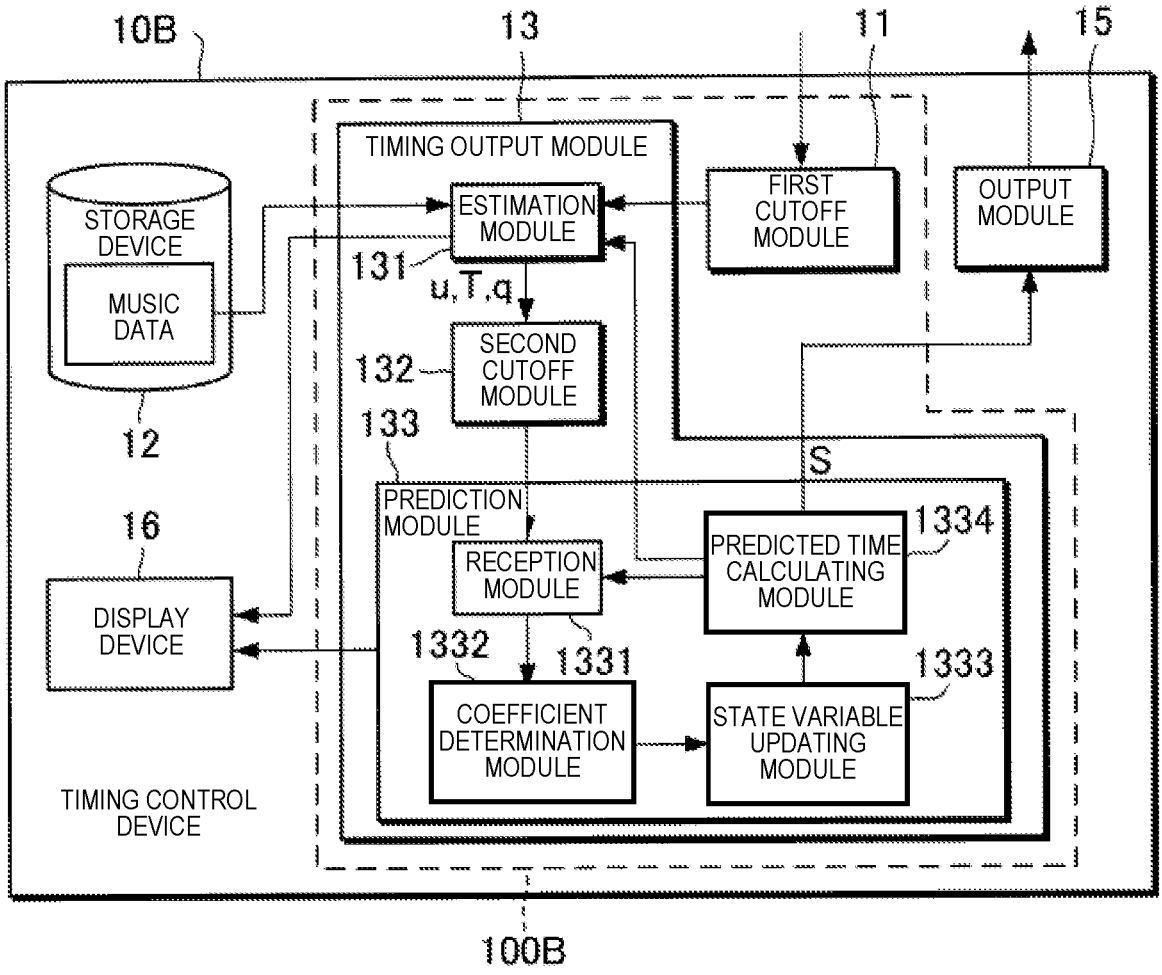
FIG. 12 is a block diagram illustrating a functional configuration of a timing control device 10B according to the sixth modified example.

FIG. 12 is a block diagram illustrating the functional configuration of a timing control device 10B according another embodiment of the modified example. The timing control device 10B is configured in the same manner as the timing control device 10 shown in FIG. 2, except for the inclusion of a timing generation module 100B instead of the timing generation module 100. In addition, the timing generation module 100B is configured in the same manner as the timing generation module 100 shown in FIG. 2, except for not including the third cutoff module 14.

Figure 13:
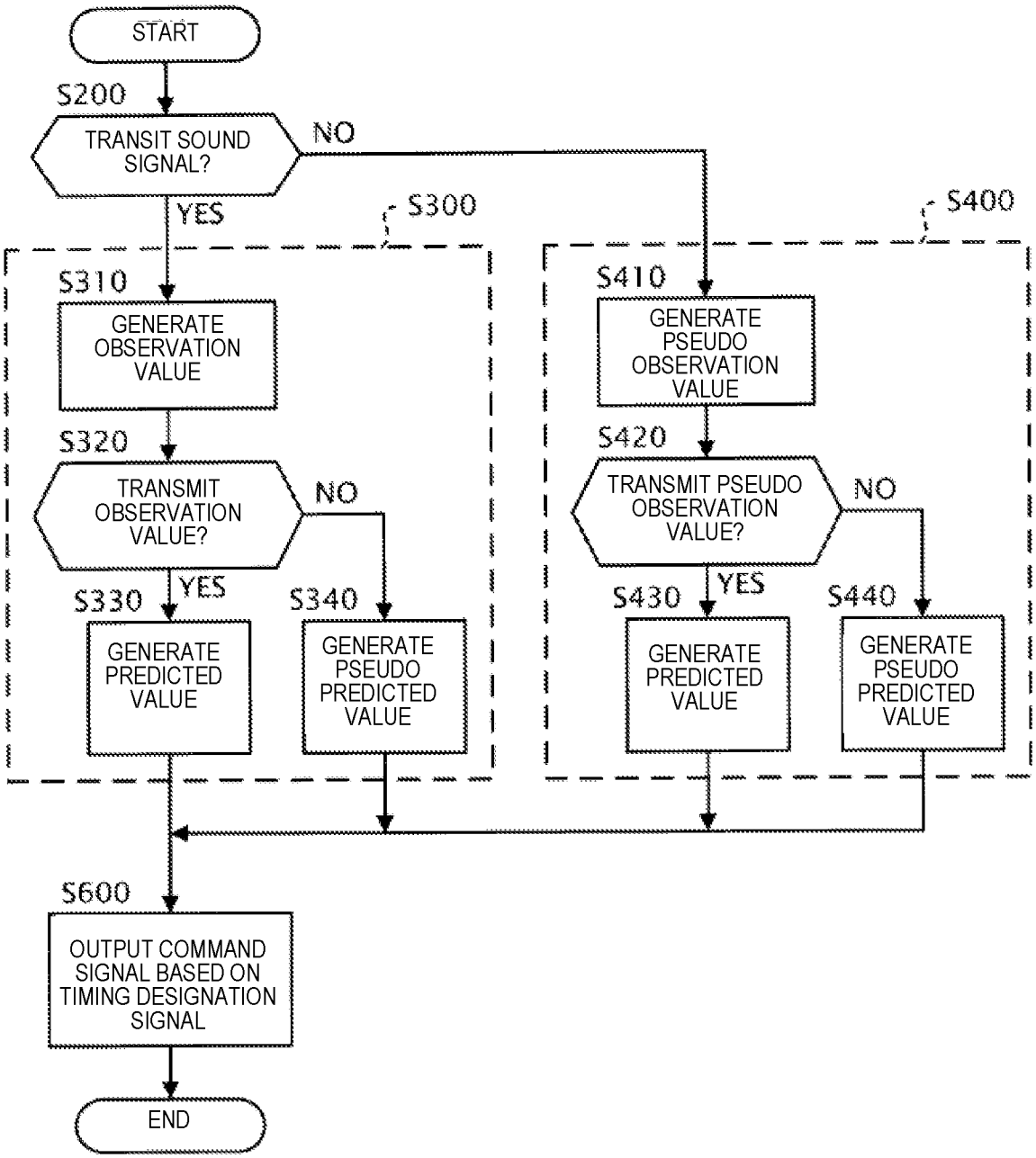
FIG. 13 is a flowchart illustrating an operation of the timing control device 10B according to the sixth modified example.

FIG. 13 is a flowchart illustrating the operation of the timing control device 10B. The flowchart shown in FIG. 13 is the same as the flowchart shown in FIG. 9, except for not including the Step S500 and the Step S700.

Since, even in the timing control device 10B such as the above, the timing generation module 100B is capable of generating the timing designation signal according to the first generation mode in which the timing designation signal is output based on the sound signal that is input from the sensor group 20, and the second generation mode in which the timing designation signal is output without using the sound signal that is input from the sensor group 20, it is possible to prevent the performance of the automatic performance instrument 30 that is based on the timing designation signal that is output from the timing generation module 100B from becoming unstable, for example, even when an unexpected "deviation" occurs in the timing at which the sound signal is output, or when noise is superimposed on the sound signal.

The timing control device 10B shown in FIG. 12 comprises the second cutoff module 132, but such a configuration is merely one example; it is not necessary for the timing control device 10B to have the second cutoff module 132. In other words, in the flowchart shown in FIG. 13, it is not necessary that the process of steps S320, S340, S420, and S440 be executed.

3-7. Seventh Modified Example

In the dynamic model relating to the embodiment described above, the state variables are updated using the observation value (the sound generation position u[n] and the observation noise q[n]) at a single point in time, but the present embodiment is not limited to such a mode; the state variables can be updated using the observation values from a plurality of points in time. Specifically, equation (12) can be used instead of equation (5) in the observation model of the dynamic model.

Equation $$\begin{pmatrix} u[n-1] \\ u[n-2] \\ \vdots \\ u[n-j] \end{pmatrix} = O_n\begin{pmatrix} x[n] \\ v[n] \end{pmatrix} + \begin{pmatrix} q[n-1] \\ q[n-2] \\ \vdots \\ q[n-j] \end{pmatrix} \tag{12}$$

Here, the matrix On represents the relationship between a plurality of observation values (in this example, the sound generation positions u[n−1], u[n−2], . . . , u[n−j]_, and the performance position x[n] and the velocity v[n], in the observation model. By updating the state variables using the plurality of observation values at the plurality of points in time, it is possible to suppress the influence of the unexpected noise that occurs in the observation values on the prediction of the sound generation time S[n+1], compared to the case in which the state variables are updated using the observation value from a single point in time.

3-8. Eighth Modified Example

In the embodiment and the modified examples described above, the state variables are updated using the first observation value, but the present embodiment is not limited to such a mode; the state variables can be updated using both the first observation value and the second observation value.

For example, when the performance position xa[n] according to the state transition model is updated, the following equation (13) can be used instead of equation (9). In equation (9), only the sound generation time T, which is the first observation value, is used as the observation value, in equation (13), the sound generation time T, which is the first observation value, and the sound generation time S, which is the second observation value, are used as the observation values.

Equation $$xa[n]=\gamma[n]\{xa[n-1]+(S[n]-S[n-1])va[n-1]+exa[n]\}+(1-\gamma[n])\{xu[n-1]+(T[n]-T[n-1])vu[n-1]+exu[n]\} \quad (13)$$

In addition, for example, when the performance position xu[n] and the performance position xa[n] according to the state transition model are updated, the following equation (14) can be used instead of equation (8), and the following equation (15) can be used instead of equation (9). Here, the sound generation time Z that appears in the following equations (14) and (15) is a collective term for the sound generation time S and the sound generation time T.

Equation $$xu[n]=xu[n-1]+(Z[n]-Z[n-1])vu[n-1]+exu[n] \quad (14)$$

$$xa[n]=\gamma[n]\{xa[n-1]+(Z[n]-Z[n-1])va[n-1]+exa[n]\}+(1-\gamma[n])\{xu[n-1]+(Z[n]-Z[n-1])vu[n-1]+exu[n]\} \quad (15)$$

In addition, as in the present modified example, when both the first observation value and the second observation value are used in the state transition model, both the first observation value and the second observation value can also be used in the observation model. Specifically, in the observation model, the state variables can be updated by using the following equation (17) in addition to equation (16), which embodies equation (5) according to the embodiment described above.

Equation $$uu[n]=xu[n]+q[n] \quad (16)$$

$$ua[n]=xa[n]+q[n] \quad (17)$$

As in the present modified example, when the state variables are updated using both the first observation value and the second observation value, the state variable updating module 1333 can receive the first observation value (the sound generation position uu and the sound generation time T) from the reception module 1331 and receive the second observation value (the sound generation position ua and the sound generation time S) from the predicted time calculating module 1334.

3-9. Ninth Modified Example

In the embodiment and modified examples described above, the predicted time calculating module 1334 uses equation (6) to calculate the performance position x[t] at a future time t, but the present embodiment is not limited to such a mode. For example, the state variable updating module 1333 can calculate the performance position x[n+1] using the dynamic model that updates the state variables.

3-10. Tenth Modified Example

The behavior of the performer P that is detected by the sensor group 20 is not limited to the performance sound. The sensor group 20 can detect a movement of the performer P instead of, or in addition to, the performance sound. In this case, the sensor group 20 includes a camera or a motion sensor.

3-11. Other Modified Examples

The algorithm for estimating the performance position in the estimation module 131 is not limited to that illustrated in the embodiment. Any algorithm can be applied to the estimation module 131 as long as the algorithm is capable of estimating the performance position on the musical score based on the musical score that is given in advance and the sound signal that is input from the sensor group 20. In addition, the observation value that is input to the prediction module 133 from the estimation module 131 is not limited to that illustrated in the embodiment. Any type of observation value other than the sound generation position u and the sound generation time T can be input to the prediction module 133 as long as the observation value relates to the timing of the performance.

The dynamic model that is used in the prediction module 133 is not limited to that illustrated in the embodiment. In the embodiment and the modified examples described above, the prediction module 133 updates the state vector Va (the second state variable) without using the observation model, but the state vector Va can be updated using both the state transition model and the observation model.

In addition, in the embodiment and the modified examples described above, the prediction module 133 updates the state vector Vu using the Kalman filter, but the state vector V can be updated using an algorithm other than with the Kalman filter. For example, the prediction module 133 can update the state vector V using a particle filter. In this case, the state transition model that is used in the particle filter can be expressed by equations (2), (4), (8), or (9) described above, or a different state transition model can be used. Additionally, the observation model that is used in the particle filter can be expressed by equations (3), (5), (10), or (11) described above, or a different observation model can be used.

In addition, state variables other than, or in addition, the performance position x and the velocity v can also be used. The equations shown in the embodiment are merely examples, and the present embodiment is not limited thereto.

The hardware configuration of each device that constitutes the ensemble system 1 is not limited to that illustrated in the embodiment. Any specific hardware configuration can be used as long as the hardware configuration can realize the required functions. For example, the timing control device 10 can comprise a plurality of processors that respectively correspond to the estimation module 131, the prediction module 133, and the output module 15, rather than the timing control device 10 functioning as the estimation module 131, the prediction module 133, and the output module 15 by means of a single processor of the electronic controller 101 executing a control program. In addition, a plurality of devices can physically cooperate with each other to function as the timing control device 10 in the ensemble system 1.

The control program that is executed by the processor of the electronic controller 101 of the timing control device 10 can be provided by means of a non-transitory storage medium, such as an optical disc, a magnetic disk, or a semiconductor memory, or can be provided by means of a download via a communication line such as the Internet. In addition, it is not necessary for the control program to include all the steps of FIG. 4. For example, the program can include only steps S31, S33, and S34.

The ensemble system 1 preferably has a function for the operator to intervene during the actual performance, such as a concert. This is because a bail-out measure is required to counter an erroneous estimation of the ensemble system 1. In this case, the ensemble system 1 can be a system in which a system parameter can be changed based on an operation by the operator, in which the system parameter can be changed to a value specified by the operator.

In addition, the ensemble system 1 preferably has a failsafe configuration in which the reproduction of the music piece cannot fail until the end is reached, even if operations such as the prediction fails. In the ensemble system 1, the state variables in an ensemble engine (the estimation module 131 and the prediction module 133) and a time stamp (sound generation time) are transmitted to a sequencer (not shown) that operates according to a process that is separate from the ensemble engine as an OSC (Open Sound Control) message on a UDP (User Datagram Protocol), and the sequencer reproduces the music data based on the received OSC. As a result, the sequencer is able to continue the reproduction of the music data, even if the ensemble engine were to fail and the process of the ensemble engine ends. In this case, the state variables in the ensemble system 1 are preferably easily expressed by a general sequencer, such as the tempo of the performance and the offset of the timing of the sound generation in the performance.

Specifically, the timing control device 10 can be provided with a second timing output module, in addition to the timing output module 13. The second timing output module comprises a second estimation module and a second prediction module, predicts the timing for sound generation the next sound in accordance with information that indicates the sound generations relating to the performance that is input from the outside of the timing control device 10, and outputs the predicted time to the output module 15 via a fourth cutoff module. The second estimation module outputs the estimated value that indicates the performance position on the musical score. The second estimation module can have the same configuration as the estimation module 131 or can utilize known technology. The second prediction module calculates the predicted value of the timing for sound generation of the next sound in the performance based on the estimated value that is output by the second estimation module. The second prediction module can have the same configuration as the prediction module 133 or can utilize known technology. The fourth cutoff module outputs the predicted value that is output by the second estimation module to the output module 15 when at least one or more of the first cutoff module 11, the second cutoff module 132, or the third cutoff module 14 is in the cutoff state.

PREFERRED ASPECTS

Preferred aspects that can be ascertained from the descriptions of the embodiment and the modified example above are illustrated below.

First Aspect

A timing control method according to a first aspect is characterized by comprising a step for generating a timing designation signal according to a first generation mode for generating the timing designation signal which designates, based on a detection result of a first event in a performance of a music piece, a timing of a second event in the performance, or according to a second generation mode for generating the timing designation signal without using the detection result; and a step for outputting a command signal according to a first output mode for outputting the command signal for commanding an execution of the second event in accordance with the timing designated by the timing designation signal, or a second output mode for outputting the command signal in accordance with the timing determined based on the music piece.

According to this aspect, it is possible to prevent the execution of the second event from becoming unstable during the performance.

Second Aspect

The timing control method according to a second aspect is characterized by comprising a step for generating, based on a detection result of a first event in a performance of a music piece, a timing designation signal that designates a timing of a second event in the performance; and a step for outputting a command signal according to a first output mode for outputting the command signal for commanding an execution of the second event in accordance with the timing designated by the timing designation signal, or a second output mode for outputting the command signal in accordance with the timing determined based on the music piece.

According to this aspect, it is possible to prevent the execution of the second event from becoming unstable during the performance.

Third Aspect

The timing control method according to a third aspect is characterized by comprising a step for generating a timing designation signal according to a first generation mode for generating the timing designation signal which designates, based on a detection result of a first event in a performance of a music piece, a timing of a second event in the performance, or according to a second generation mode for generating the timing designation signal without using the detection result; and a step for outputting a command signal for commanding an execution of the second event in accordance with the timing designated by the timing designation signal.

According to this aspect, it is possible to prevent the execution of the second event from becoming unstable in the performance.

Fourth Aspect

The timing control method according to a fourth aspect is the timing control method according to the first or the second aspect, further comprising a step for switching between whether to cut off or not to cut off a transmission of the timing designation signal, wherein, in the outputting step, the command signal is output according to the second output mode when the transmission of the timing designation signal is cut off.

According to this aspect, it is possible to prevent the execution of the second event from becoming unstable during the performance, even when the process for generating the timing designation signal becomes unstable.

Fifth Aspect

The timing control method according to a fifth aspect is the timing control method according to the fourth aspect, wherein, in the switching step, the switching is between whether to cut off or not to cut off the transmission of the timing designation signal based on the timing designation signal.

According to this aspect, it is possible to prevent the execution of the second event from becoming unstable in the performance, even when the process for generating the timing designation signal becomes unstable.

Sixth Aspect

The timing control method according to a sixth aspect is the timing control method according to the first or the thirds aspect, further comprising a step for switching between whether to cut off or not to cut off an input of a detection result, wherein, in the generating step, the timing designation signal is generated according to the second generation mode when the input of the detection result is cut off.

According to this aspect, it is possible to generate the timing designation signal without using the detection result when the process for generating the timing designation signal based on the detection result becomes unstable.

Seventh Aspect

The timing control method according to a seventh aspect is the timing control method according to the first to the sixth aspects, wherein the generating step includes a step for estimating the timing of the first event, a step for switching between whether to transmit or not to transmit a signal that indicates an estimation result, and a step for predicting the timing of the second event based on the estimation result when the signal that indicates the estimation result is transmitted.

According to this aspect, it is possible to generate the timing designation signal without using the estimation result when the process for generating the timing designation signal based on the estimation result of the timing of the first event becomes unstable.

Eighth Aspect

A timing control device according to an eighth aspect is characterized by comprising a generation module for generating a timing designation signal according to a first generation mode for generating the timing designation signal which designates, based on a detection result of a first event in a performance of a music piece, a timing of a second event in the performance, or according to a second generation mode for generating the timing designation signal without using the detection result; and an output module for outputting a command signal according to a first output mode for outputting the command signal for commanding an execution of the second event in accordance with the timing designated by the timing designation signal, or a second output mode for outputting the command signal in accordance with the timing determined based on the music piece.

According to this aspect, it is possible to prevent the execution of the second event from becoming unstable during the performance.

Ninth Aspect

The timing control device according to a ninth aspect is characterized by comprising a generation module for generating, based on a detection result of a first event in a performance of a music piece, a timing designation signal that designates a timing of a second event in the performance; and an output module for outputting a command signal according to a first output mode for outputting the command signal for commanding an execution of the second event in accordance with the timing designated by the timing designation signal, or a second output mode for outputting the command signal in accordance with the timing determined based on the music piece.

According to this aspect, it is possible to prevent the execution of the second event from becoming unstable during the performance.

Tenth Aspect

The timing control device according to a tenth aspect is characterized by comprising a generation module for generating a timing designation signal according to a first generation mode for generating the timing designation signal which designates, based on a detection result of a first event in a performance of a music piece, a timing of a second event in the performance, or according to a second generation mode for generating the timing designation signal without using the detection result; and an output module for outputting a command signal for commanding an execution of the second event in accordance with the timing designated by the timing designation signal.

According to this aspect, it is possible to prevent the execution of the second event from becoming unstable during the performance.

What is claimed is:

1. A timing control method comprising:

generating a timing designation signal according to one of a first generation mode for generating the timing designation signal which designates, based on a detection result of a first event in a performance of a music piece, a timing of a second event in the performance, and a second generation mode for generating the timing designation signal without using the detection result; and outputting a command signal for commanding an execution of the second event according to one of a first output mode for outputting the command signal in accordance with the timing designated by the timing designation signal, and a second output mode for outputting the command signal in accordance with a timing determined based on the music piece.

2. A timing control method comprising:

generating, based on a detection result of a first event in a performance of a music piece, a timing designation signal that designates a timing of a second event in the performance; and outputting a command signal for commanding an execution of the second event according to one of a first output mode for outputting the command signal in accordance with the timing designated by the timing designation signal, and a second output mode for outputting the command signal in accordance with a timing determined based on the music piece.

3. A timing control method comprising:

generating a timing designation signal according to one of a first generation mode for generating the timing designation signal which designates, based on a detection result of a first event in a performance of a music piece, a timing of a second event in the performance, and a second generation mode for generating the timing designation signal without using the detection result; and outputting a command signal for commanding an execution of the second event in accordance with the timing designated by the timing designation signal.

4. The timing control method according to claim 1, further comprising performing output switching between an output cutoff state in which a transmission of the timing designation signal is cut off and an output transmitting state in which the transmission of the timing designation signal is not cut off, wherein the outputting of the command signal is performed by outputting the command signal according to the second output mode when the output switching is in the output cutoff state.

5. The timing control method according to claim 4, wherein, the output switching between the output cutoff state and the output transmitting state is performed based on an error between the timing of the second event designated by the timing designation signal and a timing of sound generation indicated by music data of the music piece.

6. The timing control method according to claim 1, further comprising performing input switching between an input cutoff state in which an input of the detection result is cut off and an input transmitting state in which the input of the detection result is not cut off, wherein the generating of the timing designation signal is performed by generating the timing destination signal according to the second mode when the input switching is in the input cutoff state.

7. The timing control method according to claim 1, wherein the generating of the timing designation signal includes estimating a timing of the first event, performing signal switching between a signal cutoff state in which a signal that indicates an estimation result is not transmitted and a signal transmitting state in which the signal is transmitted, and predicting the timing of the second event based on the estimation result when the signal switching is in the signal transmitting state.

8. A timing control device comprising:

an electronic controller including at least one processor, the electronic controller being configured to execute a plurality of modules including a generation module that generates a timing designation signal according to one of a first generation mode for generating the timing designation signal which designates, based on a detection result of a first event in a performance of a music piece, a timing of a second event in the performance, and a second generation mode for generating the timing designation signal without using the detection result; and an output module that outputs a command signal for commanding an execution of the second event according to one of a first output mode for outputting the command signal in accordance with the timing designated by the timing designation signal, and a second output mode for outputting the command signal in accordance with a timing determined based on the music piece.

9. The timing control device according to claim 8, wherein the electronic controller is configured to further execute an output switching module that performs output switching between an output cutoff state in which a transmission of the timing designation signal is cut off and an output transmitting state in which the transmission of the timing designation signal is not cut off, and the output module outputs the command signal according to the second output mode when the output switching is in the output cutoff state.

10. The timing control device according to claim 9, wherein, the output switching module performs the output switching between the output cutoff state and the output transmitting state based on an error between the timing of the second event designated by the timing designation signal and a timing of sound generation indicated by music data of the music piece.

11. The timing control method according to claim 8, wherein the electronic controller is configured to further execute an input switching module that performs an input switching between an input cutoff state in which an input of the detection result is cut off and an input transmitting state in which the input of the detection result is not cut off, and the generation module generates the timing designation signal according to the second generation mode when the input switching is in the input cutoff state.

12. The timing control method according to claim 8, wherein the generation module estimates a timing of the first event, performs signal switching between a signal cutoff state in which a signal that indicates an estimation result is not transmitted and a signal transmitting state in which the signal is transmitted, and predicts the timing of the second event based on the estimation result when the signal switching is in the signal transmitting state.

13. The timing control method according to claim 4, wherein, the output switching between the output cutoff state and the output transmitting state is performed based on a change instruction information on a change from the output transmitting state to the output cutoff state, and the change instruction information is included in the timing designation signal.

14. The timing control device according to claim 9, wherein, the output switching module performs the output switching between the output cutoff state and the output transmitting state based on a change instruction information on a change from the output transmitting state to the output cutoff state, and the change instruction information is included in the timing designation signal.

* * * * *